US010685530B2

(12) United States Patent
Wortmann

(10) Patent No.: US 10,685,530 B2
(45) Date of Patent: Jun. 16, 2020

(54) SOFTWARE-BASED SIMULATION OF SYMBOL LOCKING

(71) Applicant: Pridefield Limited, Douglas, Isle of Man (GB)

(72) Inventor: Jonathan Bruce Wortmann, Ballarat (AU)

(73) Assignee: Pridefield Limited, Douglas, Isle of Man (GB)

( * ) Notice: Subject to any disclaimer, the term of this patent is extended or adjusted under 35 U.S.C. 154(b) by 137 days.

(21) Appl. No.: 15/795,798

(22) Filed: Oct. 27, 2017

(65) Prior Publication Data

US 2018/0122183 A1 May 3, 2018

(30) Foreign Application Priority Data

Oct. 31, 2016 (GB) ..... 1618349.3

(51) Int. Cl.
*G07F 17/32* (2006.01)

(52) U.S. Cl.
CPC ..... *G07F 17/3213* (2013.01); *G07F 17/3209* (2013.01); *G07F 17/3225* (2013.01); *G07F 17/3241* (2013.01); *G07F 17/3244* (2013.01)

(58) Field of Classification Search
CPC ..... G07F 17/3213
See application file for complete search history.

(56) References Cited

U.S. PATENT DOCUMENTS 5,704,835 A 1/1998 Dietz, II
6,142,872 A 11/2000 Walker et al.
6,146,271 A 11/2000 Kadlic
(Continued)

FOREIGN PATENT DOCUMENTS

AU 2003246319 10/2003
AU 2011253848 A1 1/2014
(Continued)

OTHER PUBLICATIONS

Non-Final Office Action dated Dec. 26, 2018, issued in connection with U.S. Appl. No. 15/392,946, filed Dec. 28, 2016, 13 pages.
(Continued)

*Primary Examiner* — Jay Trent Liddle
(74) *Attorney, Agent, or Firm* — McDonnell Boehnen Hulbert & Berghoff LLP

(57) ABSTRACT

An embodiment may involve a software application executed on behalf of a client machine with a graphical display unit, where the software application involves graphically displaying, on vertical symbol display segments of the graphical display unit, animations that simulate spinning a plurality of reels, and where each reel contains a respective plurality of symbols, subsets of which are displayable in a respective vertical symbol display segment corresponding to the reel. The embodiment may also involve iterations of: selecting a set of symbols including a locking symbol when (i) the locking symbol was locked in place from a previous spin and has been used in fewer than 3 winning combinations, or (ii) the locking symbol was initially selected during the spin of the reels; and causing the graphical display unit to display an animation of the spin of the reels in which the instance of the locking symbol remains in place.

13 Claims, 24 Drawing Sheets

(56) References Cited

U.S. PATENT DOCUMENTS 6,186,894 B1 2/2001 Mayeroff
6,190,255 B1 2/2001 Thomas et al.
6,203,429 B1 3/2001 Demar et al.
6,224,483 B1 5/2001 Mayeroff
6,231,442 B1 5/2001 Mayeroff
6,234,897 B1 5/2001 Frohm et al.
6,251,013 B1 6/2001 Bennett
6,315,560 B1 11/2001 Krouglicof et al.
6,322,309 B1 11/2001 Thomas et al.
6,379,248 B1 4/2002 Jorasch et al.
6,439,993 B1 8/2002 O'Halloran
6,482,089 B2 11/2002 DeMar et al.
6,506,117 B2 1/2003 DeMar et al.
6,508,707 B2 1/2003 DeMar et al.
6,520,855 B2 2/2003 DeMar et al.
6,561,904 B2 5/2003 Locke et al.
6,609,971 B2 8/2003 Vancura
6,645,074 B2 11/2003 Thomas et al.
6,712,697 B2 3/2004 Acres
6,743,102 B1 6/2004 Fiechter et al.
6,852,028 B2 2/2005 Vancura
6,855,054 B2 2/2005 White et al.
6,869,360 B2 3/2005 Marks et al.
6,905,412 B2 6/2005 Thomas et al.
6,939,228 B2 9/2005 Shimizu
7,063,617 B2 6/2006 Brosnan et al.
7,090,580 B2 8/2006 Rodgers et al.
7,172,505 B2 2/2007 Vancura
7,195,560 B2 3/2007 DeMar et al.
7,237,775 B2 7/2007 Thomas et al.
7,258,611 B2 8/2007 Bigelow et al.
7,291,068 B2 11/2007 Bryant et al.
7,316,609 B2 1/2008 Dunn et al.
7,331,862 B2 2/2008 Rodgers et al.
7,331,866 B2 2/2008 Rodgers et al.
7,331,867 B2 2/2008 Baelocher et al.
7,341,518 B2 3/2008 Muskin
7,381,134 B2 6/2008 Cuddy et al.
7,390,260 B2 6/2008 Englman
7,393,278 B2 7/2008 Gerson et al.
7,419,429 B2 9/2008 Taylor
7,452,271 B2 11/2008 DeMar et al.
7,520,809 B2 4/2009 Thomas et al.
7,553,231 B2 6/2009 Rodgers et al.
7,584,505 B2 9/2009 Mondri
7,618,319 B2 11/2009 Casey et al.
7,736,222 B2 6/2010 Casey et al.
7,801,040 B1 9/2010 Singh et al.
7,819,737 B2 10/2010 Englman et al.
7,850,521 B2 12/2010 Rodgers et al.
7,857,695 B2 12/2010 Rodgers et al.
7,901,283 B2 3/2011 Thomas et al.
7,922,579 B2 4/2011 Walker et al.
7,950,994 B2 5/2011 Berman et al.
8,029,358 B2 10/2011 Bigelow et al.
8,030,078 B2 10/2011 Robichaud
RE43,297 E 4/2012 Taylor
8,157,634 B2 4/2012 Englman et al.
8,177,630 B2 5/2012 Bryant
8,235,790 B2 8/2012 Yoshizawa
8,360,840 B2 1/2013 Bennett
8,382,576 B2 2/2013 Nakamura
8,430,743 B2 4/2013 Moshal
8,444,467 B2 5/2013 Englman et al.
8,449,382 B2 5/2013 Bryant
8,449,383 B2 5/2013 Bryant
8,460,094 B2 6/2013 Bigelow et al.
8,480,480 B2 7/2013 Thomas et al.
8,529,332 B2 9/2013 Bennett
8,535,143 B2 9/2013 Hornik et al.
8,540,565 B2 9/2013 Burghard et al.
8,585,484 B2 11/2013 Louie
8,591,312 B2 11/2013 Roukis et al.
8,591,316 B2 11/2013 Bryant
8,602,867 B2 12/2013 Owen
8,616,950 B2 12/2013 Robichaud
8,632,393 B2 1/2014 Bryant
8,636,584 B2 1/2014 Bryant
8,641,517 B2 2/2014 Bryant
8,647,194 B2 2/2014 Bigelow et al.
8,651,940 B2 2/2014 Loat et al.
8,702,489 B2 4/2014 Cuddy et al.
8,721,423 B2 5/2014 Saito
8,734,222 B2 5/2014 Owen et al.
8,734,237 B2 5/2014 Moshal
8,747,207 B2 6/2014 Thomas et al.
8,834,249 B2 9/2014 Bryant
8,864,568 B2 10/2014 Mizue
8,864,570 B2 10/2014 Jackson
8,876,589 B2 11/2014 Strom
8,974,288 B2 3/2015 Welty et al.
9,092,938 B2 7/2015 Robichaud
9,098,976 B2 8/2015 Zimmermann
9,129,480 B2 9/2015 Nakamura
9,135,781 B2 9/2015 Nakamura
9,135,782 B2 9/2015 Nakamura
9,165,436 B2 10/2015 Welty et al.
9,208,657 B2 12/2015 Fujisawa et al.
9,214,071 B2 12/2015 Hornik et al.
9,224,270 B2 12/2015 Lee et al.
9,230,411 B2 1/2016 Englman et al.
9,336,658 B2 5/2016 Suda
9,336,659 B2 5/2016 Beria
9,361,756 B2 6/2016 Bryant et al.
9,412,239 B2 8/2016 Gugler
9,424,720 B2 8/2016 Suda
9,564,001 B2 2/2017 Owen et al.
9,659,456 B2 5/2017 Van Linden
9,685,035 B2 6/2017 Schattauer et al.
9,697,694 B2 7/2017 Beria
9,792,776 B2 10/2017 Bigelow et al.
9,830,780 B2 11/2017 Cuddy et al.
9,852,588 B2 12/2017 Roukis et al.
9,911,280 B2 3/2018 Beria
9,934,646 B2 4/2018 Igesund
9,940,784 B2 4/2018 Schattauer et al.
9,959,703 B2 5/2018 Igesund
9,997,012 B2 6/2018 Wortmann et al.
10,043,348 B2 8/2018 Meyer
10,068,435 B2 9/2018 Gugler
10,078,942 B2 9/2018 Suda
10,147,264 B1 12/2018 Halvorson
10,169,956 B2 1/2019 Beria
2001/0009865 A1 7/2001 DeMar
2001/0031659 A1 10/2001 Perrie et al.
2002/0025847 A1 2/2002 Thomas et al.
2002/0039920 A1 4/2002 Bryant
2002/0043759 A1 4/2002 Vancura
2002/0045474 A1 4/2002 Singer et al.
2002/0068623 A1 6/2002 Gauselmann
2002/0132659 A1 9/2002 DeMar et al.
2002/0137560 A1 9/2002 DeMar et al.
2002/0137561 A1 9/2002 DeMar et al.
2002/0142823 A1 10/2002 DeMar et al.
2002/0151359 A1 10/2002 Rowe
2003/0060259 A1 3/2003 Mierau et al.
2003/0064810 A1 4/2003 Okada
2003/0073483 A1 4/2003 Glavich et al.
2003/0155715 A1 8/2003 Walker et al.
2003/0162585 A1 8/2003 Bigelow et al.
2003/0162588 A1 8/2003 Brosnan et al.
2003/0181238 A1 9/2003 DeMar et al.
2003/0190943 A1 10/2003 Walker et al.
2003/0199307 A1 10/2003 DeMar et al.
2003/0199309 A1 10/2003 DeMar et al.
2004/0032086 A1 2/2004 Barragan
2004/0048646 A1* 3/2004 Visocnik ..... G07F 17/32
463/16
2004/0072607 A1 4/2004 Thomas et al.
2004/0097280 A1 5/2004 Gauselmann
2004/0162134 A1 8/2004 Walker et al.
2004/0185930 A1 9/2004 Thomas et al.
2004/0219968 A1 11/2004 Fiden et al.
2004/0242312 A1 12/2004 Gomez

(56) References Cited

U.S. PATENT DOCUMENTS

2004/0254011 A1 12/2004 Muskin
2004/0259640 A1 12/2004 Gentles et al.
2005/0010715 A1 1/2005 Davies et al.
2005/0043082 A1 2/2005 Peterson et al.
2005/0054420 A1 3/2005 Cregan et al.
2005/0130731 A1 6/2005 Englman
2005/0130737 A1 6/2005 Englman
2005/0153770 A1 7/2005 Vancura
2005/0153778 A1 7/2005 Nelson et al.
2005/0170883 A1 8/2005 Muskin
2005/0181867 A1 8/2005 Thomas et al.
2005/0239545 A1 10/2005 Rowe
2006/0005239 A1 1/2006 Mondri
2006/0030396 A1 2/2006 Marks et al.
2006/0084494 A1 4/2006 Belger et al.
2006/0264254 A1 11/2006 Aoki
2006/0281525 A1 12/2006 Borissov
2007/0026933 A1 2/2007 Tanimura
2007/0054732 A1 3/2007 Baerlocher
2007/0060254 A1 3/2007 Muir
2007/0060303 A1 3/2007 Govender et al.
2007/0060314 A1 3/2007 Baerlocher et al.
2007/0060317 A1 3/2007 Martin
2007/0123340 A1 5/2007 Vancura
2007/0167226 A1 7/2007 Kelly et al.
2007/0265062 A1 11/2007 Thomas et al.
2007/0287529 A1 12/2007 Kojima
2008/0039171 A1 2/2008 Slomiany et al.
2008/0070673 A1 3/2008 Bennett et al.
2008/0076574 A1 3/2008 Okada
2008/0113742 A1 5/2008 Amos et al.
2008/0108411 A1 8/2008 Jensen et al.
2008/0254875 A1 10/2008 Fujimoto et al.
2008/0287178 A1 11/2008 Berman et al.
2009/0042652 A1 2/2009 Baerlocher et al.
2009/0054129 A1 2/2009 Yoshimura et al.
2009/0069071 A1 3/2009 Aoki
2009/0098930 A1 4/2009 Kato
2009/0104979 A1 4/2009 Ruymann
2009/0117979 A1 5/2009 Decasa et al.
2009/0131145 A1 5/2009 Aoki et al.
2009/0156303 A1 6/2009 Kiely et al.
2009/0227340 A1 9/2009 Yoshizawa
2009/0227356 A1 9/2009 Moroney
2009/0305769 A1 12/2009 Plowman
2009/0305770 A1 12/2009 Bennett et al.
2009/0325667 A1 12/2009 Weber
2009/0325674 A1 12/2009 Hosokawa
2010/0004048 A1 1/2010 Brito
2010/0004050 A1 1/2010 Caputo
2010/0022297 A1 1/2010 Saunders
2010/0029381 A1 2/2010 Vancura
2010/0056249 A1 3/2010 Yamauchi
2010/0120492 A1 5/2010 Davis et al.
2010/0120525 A1 5/2010 Baerlocher et al.
2010/0124988 A1 5/2010 Amos et al.
2010/0130281 A1* 5/2010 Little ..... G07F 17/3265 463/21
2010/0197377 A1 8/2010 Aoki et al.
2010/0323780 A1 12/2010 Acres
2011/0003630 A1 1/2011 Rasmussen et al.
2011/0028202 A1 2/2011 Naicker et al.
2011/0065492 A1 3/2011 Acres
2011/0098101 A1 4/2011 Gomez et al.
2011/0117987 A1 5/2011 Aoki et al.
2011/0118001 A1 5/2011 Vann
2011/0124394 A1 7/2011 Thomas et al.
2012/0015713 A1 1/2012 Cannon
2012/0040737 A1* 2/2012 Roukis ..... G07F 17/32 463/20
2012/0064961 A1 3/2012 Vancura
2012/0122546 A1 5/2012 Lange
2012/0122547 A1 5/2012 Aoki et al.
2012/0244928 A1 9/2012 Visser
2012/0258787 A1 10/2012 Bennett
2012/0276980 A1 11/2012 Moroney
2012/0295688 A1 11/2012 Watkins et al.
2013/0023329 A1 1/2013 Saunders
2013/0065662 A1 3/2013 Watkins et al.
2013/0143635 A1 6/2013 Arora
2013/0157733 A1 6/2013 Thorne et al.
2013/0184047 A1 7/2013 Haykin et al.
2013/0244762 A1 9/2013 Walker et al.
2013/0281191 A1 10/2013 Thomas et al.
2013/0288793 A1 10/2013 Fujisawa et al.
2013/0344939 A1 12/2013 Aoki et al.
2014/0051494 A1 2/2014 Marks et al.
2014/0066169 A1 3/2014 Watkins
2014/0135096 A1 5/2014 Aida et al.
2014/0179400 A1 6/2014 Lee
2014/0228091 A1 8/2014 Berman et al.
2014/0274292 A1 9/2014 Suda
2014/0287814 A1 9/2014 Berman et al.
2014/0295939 A1 10/2014 Thomas et al.
2014/0323198 A1 10/2014 Tuck
2014/0339767 A1 11/2014 Hirato
2014/0342807 A1 11/2014 Vancura
2015/0018069 A1 1/2015 Montenegro et al.
2015/0057068 A1 2/2015 Burghard
2015/0213677 A1 7/2015 Haykin et al.
2015/0248810 A1 9/2015 Wortmann et al.
2015/0248811 A1 9/2015 Wortmann et al.
2015/0287276 A1 10/2015 Humphrey et al.
2015/0302704 A1 10/2015 Montenegro et al.
2015/0363999 A1 12/2015 Little
2016/0104345 A1 4/2016 MacGregor et al.
2016/0140795 A1 5/2016 Fong et al.
2016/0180637 A1 6/2016 Honeycutt et al.
2016/0260284 A1* 9/2016 Little ..... G07F 17/3265
2016/0328910 A1 11/2016 Shaik
2016/0351005 A1 12/2016 Igesund
2016/0351006 A1 12/2016 Igesund
2017/0069160 A1 3/2017 Bennett
2017/0092041 A1 3/2017 Kudo
2017/0092042 A1 3/2017 Nakamura
2017/0124809 A1* 5/2017 Elias ..... G07F 17/32
2017/0162003 A9 6/2017 Burghard
2017/0213416 A1 7/2017 Wortmann
2017/0316648 A1 11/2017 Wortmann
2017/0316649 A1 11/2017 Wortmann
2017/0316651 A1 11/2017 Wortmann et al.
2018/0122182 A1 5/2018 Wortmann
2018/0122184 A1 5/2018 Wortmann
2018/0122189 A1 5/2018 Wortmann
2018/0225926 A1 8/2018 Wortmann
2018/0286174 A1 10/2018 Merkel et al.
2018/0286175 A1 10/2018 Kuhlmann et al.
2018/0374296 A1 12/2018 Bennett
2019/0019370 A1 1/2019 Ono

FOREIGN PATENT DOCUMENTS

AU 2013251288 5/2014
CA 2827968 3/2014
CA 2868773 4/2015
EP 1351180 10/2003
EP 2615591 3/2013
EP 2713347 4/2014
EP 2866211 4/2015
EP 2894612 7/2015
EP 2916299 9/2015
GB 2139390 11/1984
GB 2393018 3/2004
WO 2002/41963 5/2002
WO 2006/027677 3/2006
WO 2008/063394 A3 5/2008
ZA 201400816 10/2014

OTHER PUBLICATIONS

Non-Final Office Action dated Jan. 16, 2019, issued in connection with U.S. Appl. No. 15/487,838 Fl, filed Apr. 14, 2017, 12 pages.

(56) References Cited

OTHER PUBLICATIONS

Canadian Intellectual Property Office, Examiner's Report dated Jan. 15, 2019, issued in connection with Canadian Patent Application No. 2,929,218, 6 pages.
Australian Examination Report No. 4 dated Sep. 28, 2018, issued in connection with Australian Patent Application No. 2017200271, 5 pages.
Notice of Allowance dated Oct. 29, 2018, issued in connection with U.S. Appl. No. 15/487,022, filed Apr. 13, 2017, 5 pages.
Notice of Allowance dated Jul. 18, 2018, issued in connection with U.S. Appl. No. 15/487,869, filed Apr. 14, 2017, 9 pages.
United Kingdom Intellectual Property Office, Examination Report dated Jul. 30, 2018, issued in connection with Great Britain Patent Application No. 1701938.1, 6 pages.
Non-Final Office Action dated Sep. 25, 2018, issued in connection with U.S. Appl. No. 16/056,721, filed Aug. 7, 2018, 10 pages.
Notice of Allowance dated Jan. 8, 2019, issued in connection with U.S. Appl. No. 16/056,721, filed Aug. 7, 2018, 5 pages.
Notice of Allowance dated Feb. 21, 2019, issued in connection with U.S. Appl. No. 16/056,721, filed Aug. 7, 2018, 7 pages.
Australian Government, IP Australia, Examination Report No. 3 dated Jul. 23, 2018, issued in connection with Australian Patent Application No. 2017101574, 4 pages.
Australian Government, IP Australia, Examination Report No. 4 dated Jan. 15, 2019, issued in connection with Australian Patent Application No. 2017101574, 4 pages.
Australian Government, IP Australia, Examination Report No. 2 dated Aug. 9, 2018, issued in connection with Patent Australian Patent Application No. 2017235913, 4 pages.
Australian Government, IP Australia, Examination Report No. 3 dated Jan. 15, 2019, issued in connection with Australian Patent Application No. 2017235913, 3 pages.
Australian Government, IP Australia, Examination Report No. 2 dated Jun. 25, 2018, issued in connection with Australian Patent Application No. 2017235921, 3 pages.
Australian Government, IP Australia, Examination Report No. 3 dated Sep. 28, 2018, issued in connection with Australian Patent Application No. 2017235921, 3 pages.
Australian Government, IP Australia, Examination Report No. 4 dated Jan. 31, 2019, issued in connection with Australian Patent Application No. 2017235921, 3 pages.
Australian Government, IP Australia, Examination Report No. 5 dated Mar. 4, 2019 issued in connection with Australian Patent Application No. 2017235921, 3 pages.
Australian Government, IP Australia, Examination Report No. 2 dated Aug. 21, 2018, issued in connection with Australian Patent Application No. 2017235939, 4 pages.
Australian Government, IP Australia, Examination Report No. 3 dated Jan. 18, 2019, issued in connection with Australian Patent Application No. 2017235939, 3 pages.
Australian Government, IP Australia, Examination Report No. 4 dated Mar. 6, 2019, issued in connection with Australian Patent Application No. 2017235939, 3 pages.
Australian Government, IP Australia, Examination Report No. 2 dated Jul. 24, 2018, issued in connection with Australian Patent Application No. 2017235945, 4 pages.
Australian Government, IP Australia, Examination Report No. 3 dated Feb. 4, 2019, issued in connection with Australian Patent Application No. 2017235945, 3 pages.
Australian Government, IP Australia, Examination Report No. 4 dated Mar. 5, 2019, issued in connection with Australian Patent Application No. 2017235945, 3 pages.
Canadian Intellectual Property Office, Examiner's Report dated Nov. 2018, issued in connection with Canadian Patent Application No. 2,954,790, 5 pages.
European Patent Office, Office Action dated Aug. 21, 2018, issued in connection with European Patent Application No. 17153144.5, 10 pages.
United Kingdom Intellectual Property Office, Combined Search Report dated Sep. 20, 2017, issued in connection with Great Britain Patent Application No. 1607374.4, 7 pages.
Australian Government, IP Australia, Examination Report No. 1 dated Oct. 12, 2018, issued in connection with Australian Patent Application No. 2018200695, 4 pages.
Australian Government, IP Australia, Examination Report No. 1 dated Mar. 28, 2017, issued in connection with Australian Patent Application No. 2016202966, 2 pages.
Australian Government, IP Australia, Examination Report No. 1 dated Mar. 29, 2017, issued in connection with Australian Patent Application No. 2016202965, 3 pages.
Australian Government, IP Australia, Patent Examination Report No. 1, dated Dec. 20, 2012, Issued in connection with Australian Patent Application No. 2011253848, 4 pages.
Canadian Intellectual Property Office, Examiner's Report dated Dec. 7, 2016, issued in connection with CA Application No. 2929222, 3 pages.
Canadian Intellectual Property Office, Office Action dated Mar. 13, 2017, issued in connection with Canadian Patent Application No. 2929218, 6 pages.
Canadian Intellectual Property Office, Examiner's Report dated Feb. 5, 2013, issued in connection with CA Application No. 27602112, 2 pages.
European Patent Office, European Search Report dated Jul. 27, 2016, issued in connection with EP Application No. 16171834.1, 8 pages.
European Patent Office, European Search Report dated Jun. 28, 2016, issued in connection with EP Application No. 16171832.5, 8 pages.
European Patent Office, Extended European Search Report dated Feb. 24, 2012, issued in connection with EP Application No. 11194636.4, 6 pages.
European Patent Office, Extended European Search Report dated Oct. 26, 2010, issued in connection with EP Application No. 10251152.4, 8 pages.
European Patent Office, Supplementary European Search Report dated Oct. 8, 2008, issued in connection with EP Application No. 05789874.4, 6 pages.
Final Office Action dated Sep. 14, 2012, issued in connection with U.S. Appl. No. 12/511,391, filed Jul. 29, 2009, 14 pages.
Final Office Action dated Jun. 23, 2010, issued in connection with U.S. Appl. No. 10/550,744, filed Aug. 24, 2006, 13 pages.
Final Office Action dated Sep. 28, 2009, issued in connection with U.S. Appl. No. 10/550,744, filed Aug. 24, 2006, 11 pages.
Intellectual Property Office, Combined Search Report and Abbreviated Examination Report dated Nov. 29, 2016, issued in connection with Application No. GB1509339.6, 7 pages.
Intellectual Property Office, Combined Search Report and Abbreviated Examination Report dated Nov. 29, 2016, issued in connection with Application No. GB1509340.4, 7 pages.
International Bureau, International Preliminary Report on Patentability dated Mar. 13, 2007, issued in connection with International Application No. PCT/IB2005/002678, filed on Sep. 9, 2005, 4 pages.
International Searching Authority, International Search Report and Written Opinion dated Jan. 16, 2007, issued in connection with International Application No. PCT/IB2005/002678, filed on Sep. 9, 2005, 8 pages.
Non-Final Office Action dated Apr. 4, 2008, issued in connection with U.S. Appl. No. 10/550,744, filed Aug. 24, 2006, 8 pages.
Non-Final Office Action dated Dec. 10, 2012, issued in connection with U.S. Appl. No. 12/974,690, filed Dec. 21, 2009, 25 pages.
Non-Final Office Action dated Dec. 24, 2009, issued in connection with U.S. Appl. No. 10/550,744, filed Aug. 24, 2006, 12 pages.
Non-Final Office Action dated Mar. 29, 2012, issued in connection with U.S. Appl. No. 12/511,391, filed Jul. 29, 2009, 10 pages.
Non-Final Office Action dated Nov. 29, 2013, issued in connection with U.S. Appl. No. 13/856,214, filed Apr. 3, 2013, 19 pages.
Non-Final Office Action dated Jul. 31, 2013, issued in connection with U.S. Appl. No. 13/856,124, filed Apr. 3, 2013, 19 pages.
Notice of Allowability dated Nov. 26, 2010, issued in connection with U.S. Appl. No. 10/550,744, filed Aug. 24, 2006, 4 pages.

(56) References Cited

OTHER PUBLICATIONS

Notice of Allowance dated Apr. 10, 2014, issued in connection with U.S. Appl. No. 13/856,124, filed Apr. 3, 2013, 7 pages.
Notice of Allowance dated Mar. 11, 2013, issued in connection with U.S. Appl. No. 12/974,690, filed Dec. 21, 2009, 14 pages.
Wortmann, Jonathan, U.S. Appl. No. 15/485,984, filed Apr. 12, 2017, 62 pages.
Wortmann, Jonathan, U.S. Appl. No. 15/487,869, filed Apr. 14, 2017, 46 pages.
Wortmann, Jonathan, U.S. Appl. No. 15/487,022, filed Apr. 13, 2017, 60 pages.
Wortmann, Jonathan, U.S. Appl. No. 15/487,838, filed Apr. 14, 2017, 64 pages.
European Patent Office, Extended European Search Report dated Jun. 6, 2017, issued in connection with Application No. EP 17153144.5, 9 pages.
Australian Government, IP Australia, Examination Report No. 2 dated Jul. 14, 2017, issued in connection with Australian Patent Application No. 2016202966, 6 pages.
Australian Government, IP Australia, Examination Report No. 1 dated Oct. 14, 2017, issued in connection with Australian Patent Application No. 2017200271, 4 pages.
Australian Government, IP Australia, Examination Report No. 2 dated Jun. 26, 2017, issued in connection with Australian Patent Application No. 2016202965, 2 pages.
Australian Government, IP Australia, Examination Report No. 3 dated Oct. 12, 2017, issued in connection with Australian Patent Application No. 2016202965, 3 pages.
Non-Final Office Action dated Oct. 18, 2017, issued in connection with U.S. Appl. No. 15/140,945, filed Apr. 28, 2016, 11 pages.
Wortmann, Jonathan, U.S. Appl. No. 15/795,546, filed Oct. 27, 2017, 49 pages.
Wortmann, Jonathan, U.S. Appl. No. 15/796,122, filed Oct. 27, 2017, 73 pages.
Wortmann, Jonathan, U.S. Appl. No. 15/796,380, filed Oct. 27, 2017, 79 pages.
Australian Government, IP Australia, Notice of Acceptance dated Sep. 25, 2013, issued in connection with Australian Patent Application No. 2011253848, 2 pages.
Australian Government, IP Australia, Examination Report No. 4 dated Mar. 9, 2018, issued in connection with Australian Patent Application No. 2016202966, 3 pages.
Australian Government, IP Australia, Examination Report No. 2 dated Mar. 6, 2018, issued in connection with Australian Patent Application No. 2017200271, 3 pages.
Australian Government, IP Australia, Examination Report No. 3 dated Jun. 5, 2018, issued in connection with Australian Patent Application No. 2017200271, 3 pages.
Australian Government, IP Australia, Examination Report No. 2 dated May 11, 2018, issued in connection with Australian Patent Application No. 2017202474, 4 pages.
Australian Government, IP Australia, Examination Report No. 2 dated May 14, 2018, issued in connection with Australian Patent Application No. 2017202574, 4 pages.
Australian Government, IP Australia, Examination Report No. 2 dated May 14, 2018, issued in connection with Australian Patent Application No. 2017202577, 3 pages.
Australian Government, IP Australia, Examination Report No. 2 dated May 14, 2018, issued in connection with Australian Patent Application No. 2017202579, 4 pages.
Australian Government, IP Australia, Examination Report No. 1 dated Mar. 20, 2018, issued in connection with Australian Patent Application No. 2017235913, 2 pages.
Australian Government, IP Australia, Examination Report No. 1 dated Mar. 6, 2018, issued in connection with Australian Patent Application No. 2017235921, 2 pages.
Australian Government, IP Australia, Examination Report No. 1 dated Mar. 6, 2018, issued in connection with Australian Patent Application No. 2017235939, 2 pages.
Australian Government, IP Australia, Examination Report No. 1 dated Mar. 6, 2018, issued in connection with Australian Patent Application No. 2017235945, 2 pages.
Canadian Intellectual Property Office, Examiner's Report dated Feb. 6, 2014, issued in connection with Canadian Patent Application No. 2,760,112, 3 pages.
Canadian Intellectual Property Office, Examiner's Report dated Mar. 18, 2015, issued in connection with Canadian Patent Application No. 2,760,112, 6 pages.
Canadian Intellectual Property Office, Final Office Action dated Dec. 2, 2016, issued in connection with Canadian Patent Application No. 2,760,112, 5 pages.
Canadian Intellectual Property Office, Examiner's Report dated May 11, 2018, issued in connection with Canadian Patent Application No. 2,964,233, 5 pages.
Canadian Intellectual Property Office, Examiner's Report dated Mar. 29, 2018, issued in connection with Canadian Patent Application No. 2,964,558, 6 pages.
Canadian Intellectual Property Office, Examiner's Report dated May 11, 2018, issued in connection with Canadian Patent Application No. 2,964,587, 5 pages.
Canadian Intellectual Property Office, Examiner's Report dated Apr. 24, 2018, issued in connection with Canadian Patent Application No. 2,964,739, 5 pages.
European Patent Office, Office Action dated Sep. 10, 2013, issued in connection with EP Application No. 11194636.4, 5 pages.
United Kingdom Intellectual Property Office, Search Report dated Apr. 13, 2018, issued in connection with Great Britain Patent Application No. 1618347.7, 6 pages.
United Kingdom Intellectual Property Office, Search Report dated Apr. 17, 018, issued in connection with Great Britain Patent Application No. 1618349.3, 7 pages.
United Kingdom Intellectual Property Office, Search Report dated Apr. 17, 2018, issued in connection with Great Britain Patent Application No. 1618352.7, 7 pages.
United Kingdom Intellectual Property Office, Search Report dated Apr. 13, 2018, issued in connection with Great Britain Patent Application No. 1618353.5, 6 pages.
Notice of Allowance dated Mar. 8, 2018, issued in connection with U.S. Appl. No. 15/140,945, filed Apr. 28, 2016, 5 pages.
Notice of Allowance dated Apr. 11, 2018, issued in connection with U.S. Appl. No. 15/485,984, filed Apr. 12, 2017, 7 pages.
Non-Final Office Action dated May 22, 2018, issued in connection with U.S. Appl. No. 15/487,022, filed Apr. 13, 2017, 12 pages.
Canadian Intellectual Property Office, Examiner's Report dated Jan. 16, 2018, issued in connection with Canadian Patent Application No. 2,929,218, 8 pages.
Australian Government, IP Australia, Examination Report No. 3 dated Nov. 21, 2017, issued in connection with Australian Patent Application No. 2016202966, 4 pages.
Notice of Allowance dated Dec. 20, 2017, issued in connection with U.S. Appl. No. 15/141,010, filed Apr. 28, 2016, 8 pages.
Non-Final Office Action dated Jan. 29, 2018, issued in connection with U.S. Appl. No. 15/487869, filed Apr. 14, 2017, 12 pages.
Canadian Intellectual Property Office, Examiner's Report dated Dec. 19, 2017, issued in connection with Canadian Patent Application No. 2,954,790, 3 pages.
United Kingdom Intellectual Property Office, Search Report dated Jun. 28, 2017, issued in connection with Great Britain Patent Application No. 1601306.2, 6 pages.
Canadian Intellectual Property Office, Examiner's Report dated Dec. 19, 2017, issued in connection with Canadian Patent Application No. 2,929,222, 6 pages.
European Patent Office, Office Action dated Aug. 23, 2017, issued in connection with EP Application No. 16171832.5, 7 pages.
Non-Final Office Action dated Oct. 18, 2017, issued in connection with U.S. Appl. No. 15/140,945, filed Apr. 28, 2016, 12 pages.
Notice of Allowance dated Jan. 16, 2018, issued in connection with U.S. Appl. No. 15/140,945, filed Apr. 28, 2016, 5 pages.
Non-Final Office Action dated Feb. 20, 2018, issued in connection with U.S. Appl. No. 15/485,984, filed Apr. 12, 2017, 11 pages.
Notice of Allowance dated Feb. 13, 2018, issued in connection with U.S. Appl. No. 15/141,010, filed Apr. 28, 2016, 5 pages.

(56) References Cited

OTHER PUBLICATIONS

Australian Government, IP Australia, Examination Report No. 1 dated Jan. 30, 2018, issued in connection with Australian Patent Application No. 2017202577, 2 pages.
Australian Government, IP Australia, Examination Report No. 1 dated Jan. 30, 2018, issued in connection with Australian Patent Application No. 2017202579, 2 pages.
Australian Government, IP Australia, Examination Report No. 1 dated Jan. 30, 2018, issued in connection with Australian Patent Application No. 2017202474, 2 pages.
Australian Government, IP Australia, Examination Report No. 1 dated Jan. 30, 2018, issued in connection with Australian Patent Application No. 2017202574, 2 pages.
Australian Government, IP Australia, Examination Report No. 4 dated Feb. 19, 2018, issued in connection with Australian Patent Application No. 2016202965, 3 pages.
United Kingdom Intellectual Property Office, Search Report dated Aug. 16, 2017, issued in connection with Great Britain Patent Application No. 1607379.3, 6 pages.
United Kingdom Intellectual Property Office, Search Report dated Aug. 11, 2017, issued in connection with Great Britain Patent Application No. 1607380.1, 8 pages.
Non-Final Office Action dated Apr. 29, 2019, issued in connection with U.S. Appl. No. 15/487,838, filed Apr. 14, 2017, 6 pages.
Canadian Intellectual Property Office, Examiner's Report dated Apr. 9, 2019, issued in connection with Canadian Patent Application No. 2,964,587, 6 pages.
Non-Final Office Action dated Apr. 29, 2019, issued in connection with U.S. Appl. No. 15/795,546, filed Oct. 27, 2017, 11 pages.
Final Office Action dated Apr. 1, 2019, issued in connection with U.S. Appl. No. 15/392,946, filed Dec. 28, 2016, 16 pages.

* cited by examiner

645

645

645

1000

1100

SOFTWARE-BASED SIMULATION OF SYMBOL LOCKING

CROSS-REFERENCE TO RELATED APPLICATION

This application claims priority to U.K. patent application no. 1618349.3, filed Oct. 31, 2016, which is hereby incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For instance, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine by the computer network. In this instance, the server machine may perform the spins of the game and may send data representing the resulting symbols to the client machine, thereby instructing the client machine to display the symbols.

The popularity of video slot games has increased due to the incorporation of novel features, such as a "WILD" symbol, into such games. A WILD symbol, which is usually the highest-ranking symbol of the game, offers line payouts, just like any other symbol and, additionally, substitutes for any other symbol in the game, thereby assisting in making winning results and providing a player with entertainment and additional opportunities to win games.

The embodiments described herein overcome limitations of past technology by increasing the number and variety of possible outcomes in a random selection of data entries based on a reel-based game of luck. Existing arrangements could only address this problem by changing the reels and/or increasing the number of symbols on the reels. The present solution includes an additional data entry in a computer-implemented draw, wherein the additional data entry can take a different value depending on the number of other additional data entries in the same draw. By creating a cross-dependency between the data entries for each of the reels in a draw (e.g., by checking how many trigger symbols or WILD symbols are found across all reels) where the symbols are changed depending on how many trigger or WILD symbols are found, the present solution can increase the number of possible outcomes with the same number of entries in a reel.

Viewed from a first aspect, the disclosure provides a computer-implemented method that involves a gaming machine determining that a trigger event for a bonus game occurred during a base outcome event of a base game. The base game and the bonus game are both reel-based games being executed on behalf of a client machine. Both the base game and the bonus game involve spinning a plurality of reels, each reel containing a respective plurality of symbols, to determine outcome events. A memory of the gaming machine stores respective pluralities of symbols for the reels. In response to determining that the trigger event occurred, the gaming machine awards a number of spins of the reels in an instance of the bonus game. The symbols for the reels used in the bonus game include a predetermined locking symbol. Until the awarded number of bonus game spins have been performed, the gaming machine repeatedly carries out iterations of bonus game operations. These operations include selecting a set of symbols associated with respective positions of each of the reels. The selected set of symbols represent an outcome event of a respective iteration of the bonus game and may include an instance of the predetermined locking symbol. The instance of the predetermined locking symbol is included when the instance of the predetermined locking symbol was locked in place from a previous iteration of the bonus game and has been used in fewer than n winning combinations of symbols in the bonus game. Alternatively, the instance of the predetermined locking symbol may be initially selected during the respective iteration of the bonus game. The operations also include transmitting, to the client machine, a representation of the selected set of symbols. Reception of the selected set of symbols causes the client machine to display the bonus game spin of the plurality of reels resulting in the selected set of symbols.

Viewed from a second aspect, the disclosure provides a computer-implemented method for symbol selection in a reel-based game, where the reel-based game is executed on behalf of a client machine. The reel-based game involves spinning a plurality of reels to determine outcome events, and a memory stores respective pluralities of symbols for the reels. A first set of symbols associated with respective positions of each of the reels is selected as an outcome event of the reel-based game. The first set of symbols is stored in the memory. It may be determined that that the outcome event includes a trigger event that causes execution of a bonus game. The bonus game includes a predetermined number of bonus outcome events. The symbols for the reels used in the bonus game include a predetermined locking symbol. A second set of symbols associated with respective positions of each of the reels is selected as a bonus outcome event of the reel-based game. The second set of symbols is stored in the memory. Any instance of the predetermined locking symbol in the second set of symbols is locked in place. Each respective locked predetermined locking symbol persists until the respective locked predetermined locking symbol has been a part of n winning bonus outcome events. A third set of symbols associated with the respective positions of each of the reels is selected as a further bonus outcome event of the reel-based game. The third set of symbols includes the locked predetermined locking symbols from the second set of symbols.

Viewed from a third aspect, the disclosure provides an article of manufacture including a non-transitory computer-readable medium, having stored thereon program instructions that, upon execution by a gaming machine, cause the gaming machine to perform the operations of the first and/or second aspect.

Viewed from a fourth aspect, the disclosure provides a gaming machine configured to perform the operations of the first and/or second aspect.

Viewed from a fifth aspect, the disclosure provides a system comprising means for performing the operations of the first and/or second aspect.

Viewed from a sixth aspect, the disclosure provides a gaming system that comprises a plurality of gaming devices each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more gaming device processors; and one or more gaming device memory devices storing (i) respective pluralities of symbols for the reels and (ii) a plurality of gaming device instructions. The gaming device instructions are executable by the one or more gaming device processors to perform the operations of the first and/or second aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A symbol displayed within a symbol-display-portion of a display during an outcome event may be replaced by another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines, systems, and methods for carrying out aspects of outcome events that include displaying symbols. These aspects may be incorporated into games, in particular, wager games. In one aspect, the machines, systems, and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often increase their profits simply by getting more players to play more games. Due to the provided features, players may be drawn in (e.g., from competing casinos that lack games with such a feature) and they may play the game often. The feature can include new data communications between a server machine and a client machine within a server-client based configuration.

II. Example Architecture

Figure 1:
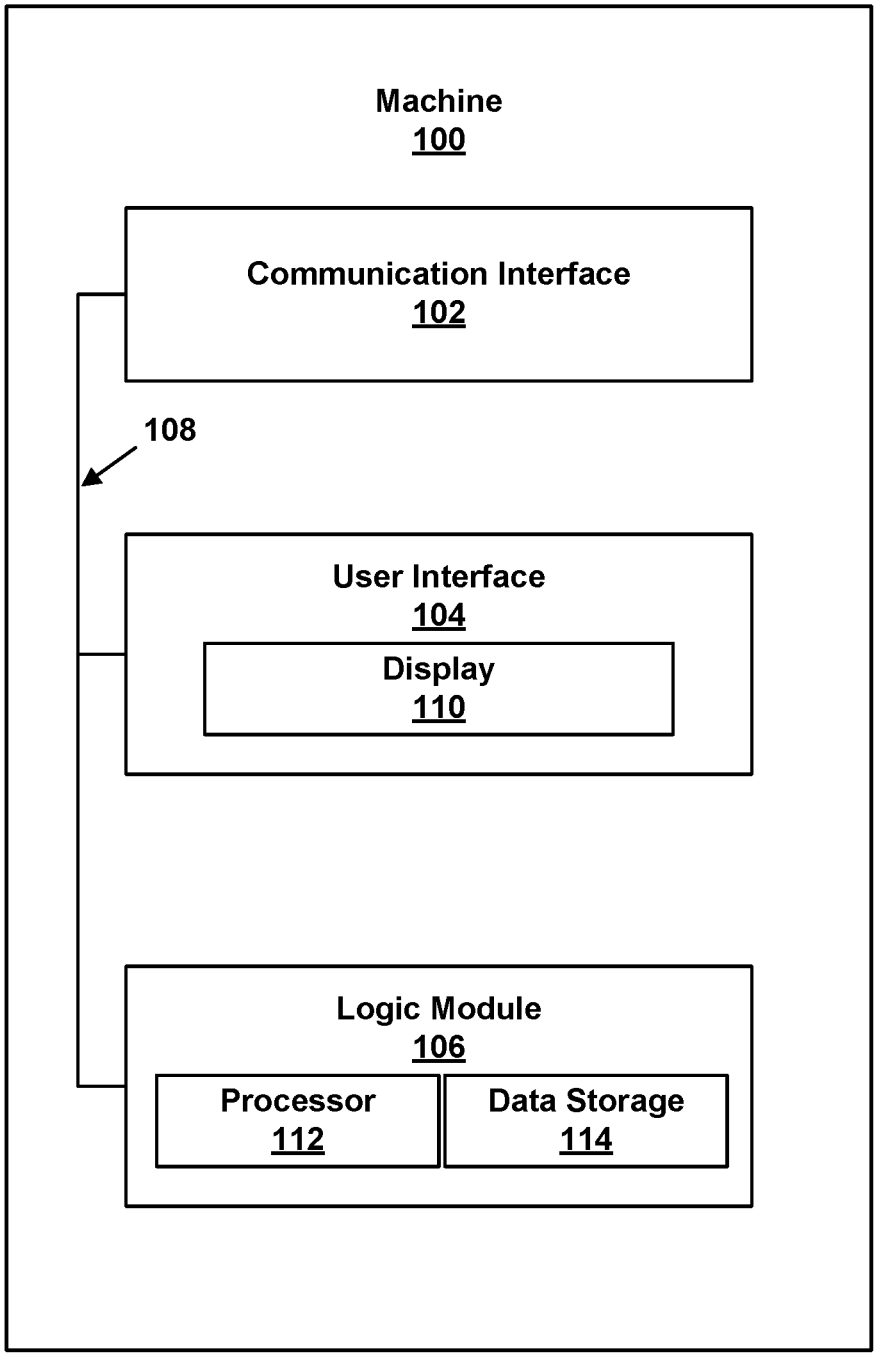
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad, keyboard, mouse, or a touch-sensitive screen. As described in greater detail below, display 110 may be configured to show, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
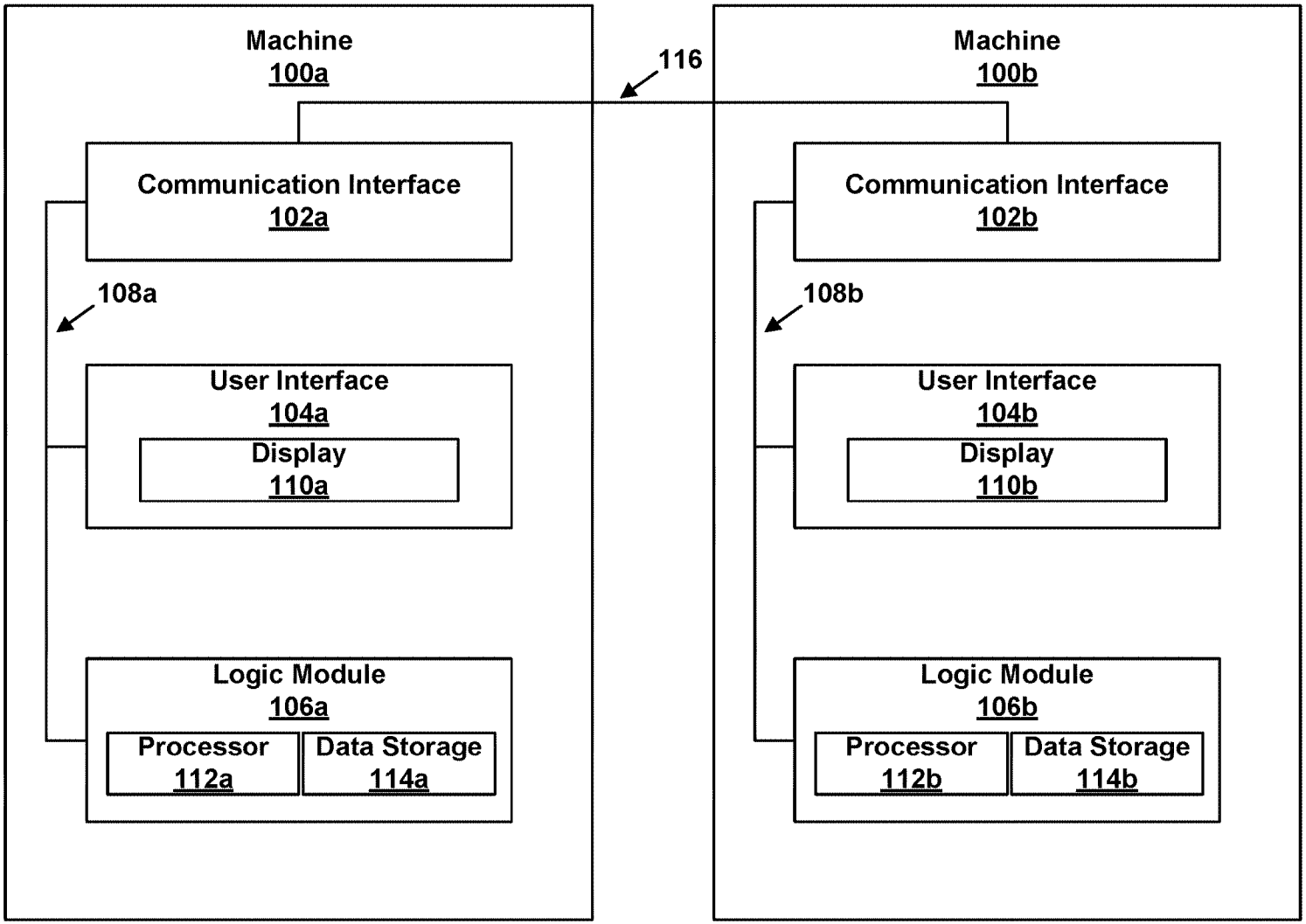
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a communication network 116. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). Server machine 100*a* includes communication interface 102*a*, user interface 104*a* (which incorporates display screen 110*a*), logic module 106*a* (which incorporates processor 112*a* and data storage 114*a*), and communication bus 108*a*. Likewise, client machine 100*b* includes communication interface 102*b*, user interface 104*b* (which incorporates display screen 110*b*), logic module 106*b* (which incorporates processor 112*b* and data storage 114*b*), and communication bus 108*b*.

The server machine 100*a* is configured to communicate with the client machine 100*b* over communication network 116 (via the communication interfaces 102*a*, 102*b*). Likewise, the client machine 100*b* is configured to communicate with the server machine 100*a* over the communication network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The communication network 116 for the server-client based configuration described above may take a variety of forms. For example, the communication network 116 may be a local area network (LAN) in a casino, such that client machines 100*b* dispersed throughout the casino may communicate with the server machine 100*a* in the casino.

In another example, the communication network 116 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The communication network 116 may include any of a variety of network topologies and network devices, and may employ traditional network-related technologies, including for example the public switched telephone network, cable networks, cellular wireless networks, WiFi, and WiMAX. Further, the communication network 116 may include one or more databases (e.g., a player credit account database), to allow for the storing and retrieving of data related to performing an outcome event by a machine, as well as adjusting account balances associated with client machines.

In some examples, machine 100 may include an acceptor of a physical item associated with a monetary value, such as a paper money acceptor, coin acceptor, or a card reader. This acceptor may include a validator configured to identify the physical item, and determine whether the physical item is suitable as payment to the machine.

In some examples, machine 100 may also physically dispense a corresponding payout (e.g., cash), or otherwise facilitate the payout to the player (by adding funds to an electronic account associated with a gaming card). Such an activity may be triggered by a cash out button either on display 110 or elsewhere on machine 100. Additionally or alternatively to determining the payout amount, machine 100 may perform other actions to award the player. For instance, the machine may display an indication of a tangible prize. Other types of awards may be used as well.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Data storage 114, 114*a*, and 114*b* can also store data. As an example, a global symbol group for a reel-based game may include multiple symbols, such as a WILD, an ace, a king, a queen, a jack and a ten that may be used in connection with the outcome event, such as a wager game. The ace, king, queen, jack and ten symbols can represent symbols found on a standard deck of playing cards. The WILD symbol may have special properties that allow it to form winning combinations with other symbols.

However, such a global symbol group may be customized with particular symbols as desired. As some possible examples, the symbols may include images of people, animals, dinosaurs, fanciful creatures, cartoon characters, inanimate objects, or other things in addition to or instead of WILD, ace, king, queen, jack, or ten symbols. Furthermore, WILD symbols may vary in design. Examples of some possible symbols are shown in the accompanying drawings.

Figure 3:
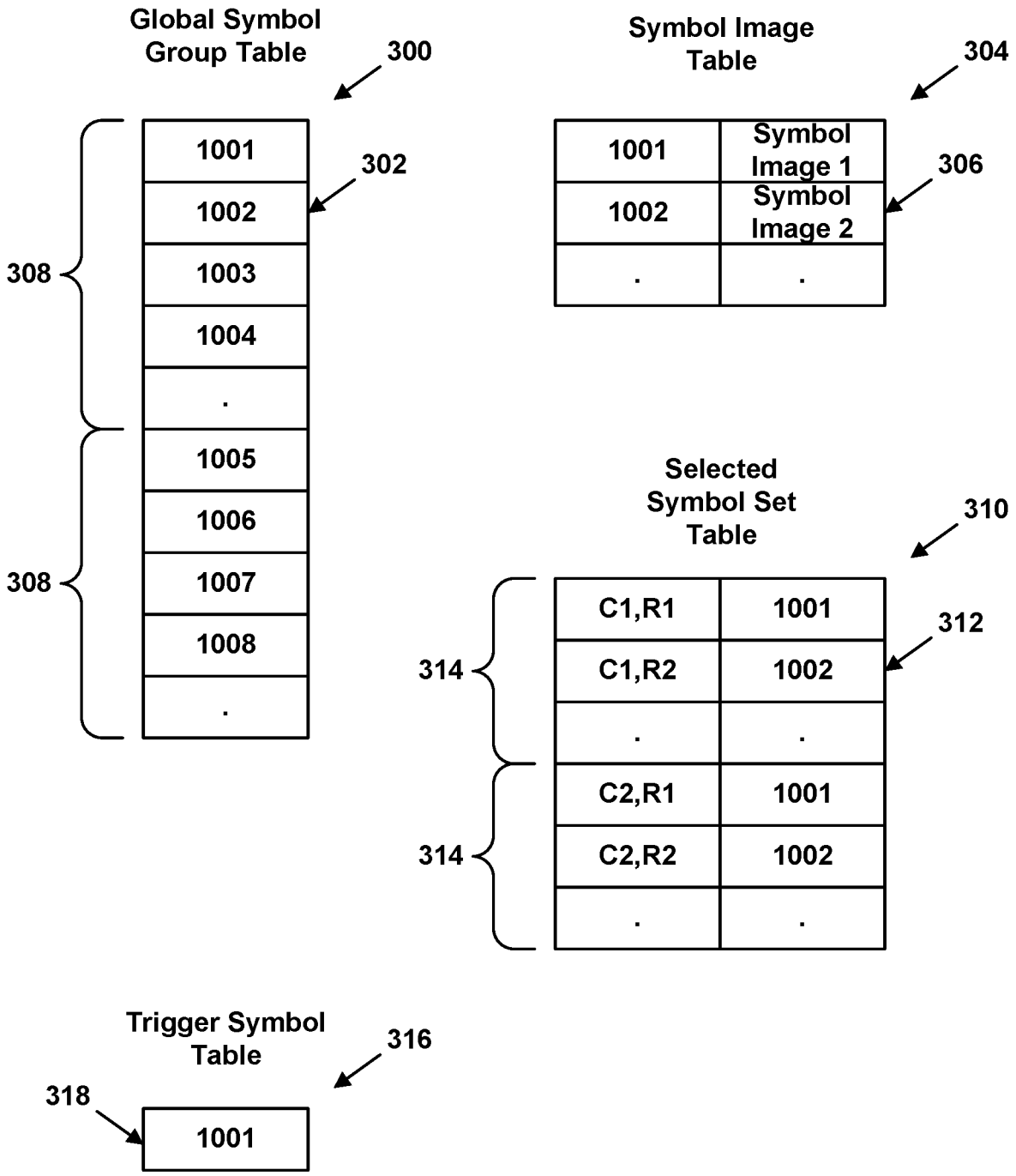
FIG. 3 depicts diagrams of tables that may be used with the processes, machines, and systems herein, in accordance with example embodiments.

In one example, the global symbol group may be represented as a table (or other data structure) stored in data storage 114. FIG. 3 shows an example global symbol group table 300. The global symbol group table 300 includes multiple records 302, each including an identifier (e.g., 1001, 1002, 1003 1004, etc.) that represents a particular symbol. In one example, the global symbol group, and therefore the global symbol group table 300, may be divided into multiple sub-groups 308 as discussed in greater detail below.

The global symbol group table 300 may be used in connection with a symbol image table 304. The symbol image table 304 includes multiple records 306 (shown as distinct rows of table 304), each including an identifier that represents a particular symbol, and a corresponding displayable image. As such, the symbol image table 304 may be used to map an identifier in the global symbol group table 300 to a displayable image. Such an image may be arranged according to the Joint Photographic Experts Group (JPEG), Graphics Interchange Format (GIF), or Portable Network Graphics (PNG) encodings, for example.

During the course of a game, various symbol sets may be selected for display. Each selected symbol set may be stored in a table such as selected symbol set table 310. Selected symbol set table 310 includes multiple records 312 (shown as distinct rows in selected symbol set table 310), each record including an arrangement position of the symbol, and an identifier that represents the symbol. As such, each symbol in the selected symbol set may correspond with a respective arrangement position in a display arrangement (e.g., both a column number and a row number in a column-and-row arrangement). As an example, C1,R1, shown in the selected symbol set table 310, represents a symbol position at column 1 (e.g., a left-most column of a plurality of columns in a symbol-display-portion of display 110) and row 1 (e.g., a top row of a plurality of rows in a symbol-display-portion of display 110). The column identifiers in selected symbol set table 310 (e.g., C1 and C2) can refer to columns in a symbol matrix or reels of a plurality of reels that can be spun.

In one example, machine 100 may select the first symbol set by iterating through each record 312 in the selected symbol set table 310, and selecting a symbol identifier from among the symbol identifiers in the global symbol group table 300. In some examples, the symbol identifiers are numbers and machine 100 uses a random number generator to select such numbers, and therefore to randomly select symbols.

In some examples, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play," namely those included in the selected symbol set.

In some examples, the selected symbol set may be partially restricted. For instance, the selected symbol set may include an instance of a predetermined symbol from the global symbol group, for example, a WILD symbol. In another example, the predetermined symbol may be in a subgroup of global symbol group table 300 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Thus, a sub-group 308 may represent an ordering of symbols on a particular reel.

Figure 4:
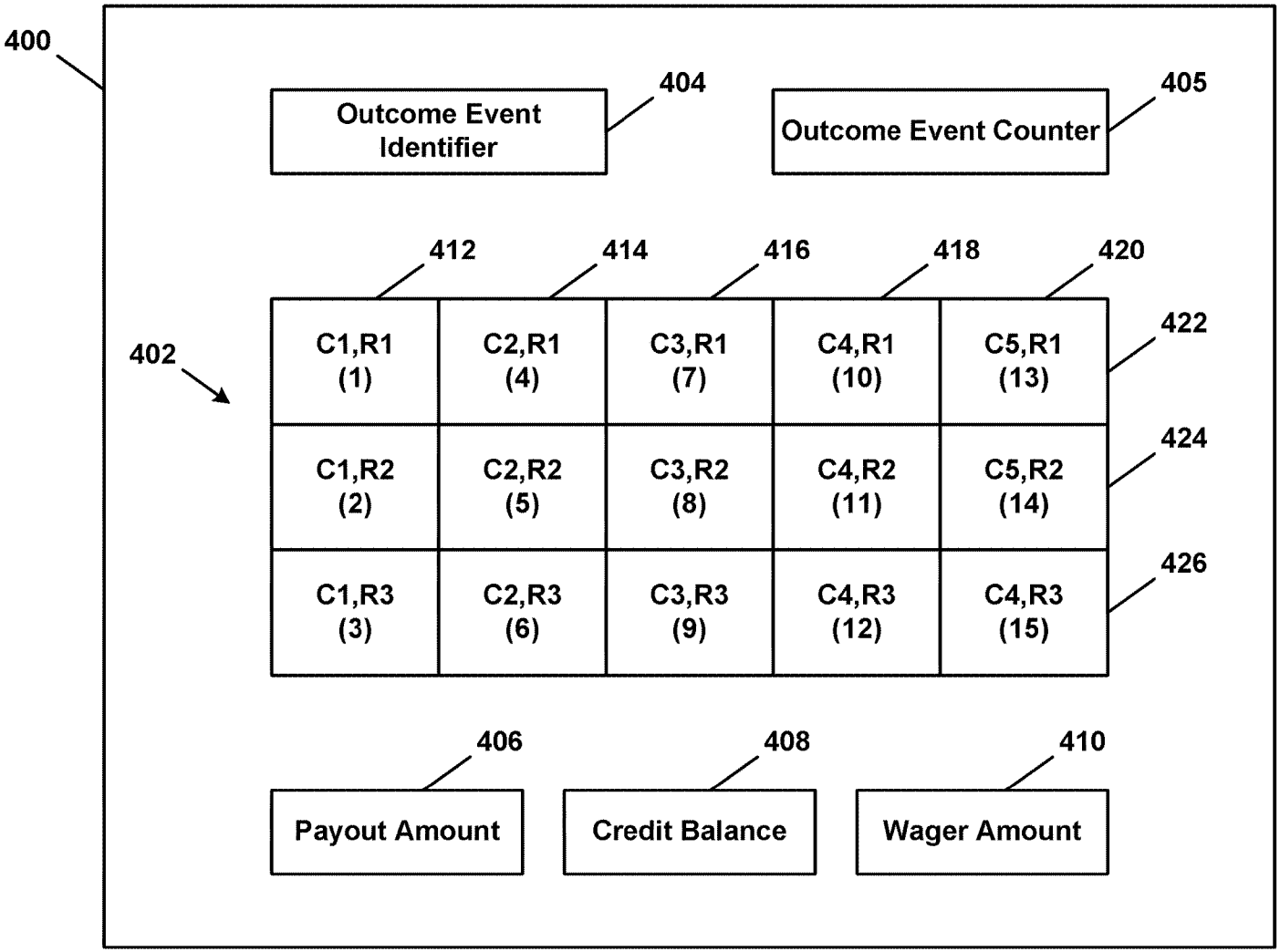
FIG. 4 depicts elements displayable by a display of a machine, in accordance with example embodiments.

FIG. 4 depicts a screenshot 400 that machine 100, server machine 100*a*, or client machine 100*b* can visually present (i.e., display) using displays 110, 110*a*, and 110*b*, respectively. For purposes of this description, each element of screenshot 400 can be a displayable element of the display. Screenshot 400 includes a symbol-display-portion 402, an outcome event identifier 404, an outcome event counter 405, a payout amount indicator 406, a credit balance indicator 408, and a wager amount indicator 410.

Symbol-display-portion 402 can include multiple symbol-display-segments and multiple symbol positions. As an example, the symbol-display-segments can include vertical symbol-display-segments 412, 414, 416, 418, and 420 (or more simply, vertical SDSs 412-420). As another example, the symbol-display-segments can include horizontal symbol-display-segments 422, 424, and 426 (or more simply, horizontal SDSs 422-426). Each symbol-display-segment can include multiple symbol positions. The vertical SDSs 412-420 are shown in FIG. 4 as having three symbol positions. The horizontal SDSs 422-426 are shown in FIG. 4 as having five symbol positions. A person skilled in the art will understand that those symbol-display-segments can be configured with different numbers of symbol positions than shown in FIG. 4.

The vertical SDSs 412-420 can be configured as spinnable reels. The processor of a machine or system displaying screenshot 400 can display the spinnable reels spinning and stopped after spinning. For vertical SDSs 412-420, the spinnable reels may spin in a vertical direction (e.g., top to bottom or bottom to top, with respect to the symbol-display-portion 402).

The horizontal SDSs 422-426 can be configured as spinnable reels. The processor of a machine or system displaying screenshot 400 can display the spinnable reels spinning and stopped after spinning. For horizontal SDSs 422-426, the spinnable reels may spin in a horizontal direction (e.g., left to right or right to left, with respect to the symbol-display-portion 402).

Machine 100 can cause symbol-display-segments to spin, and to cause spinning symbol-display-segments to stop spinning. The spinning and stopping of the spinning symbol-display-segments can be carried out for each outcome event. In accordance with the embodiments in which the symbol-display-portion 402 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

The multiple symbol positions in symbol-display-portion 402 are identified by column and row designators, in which C1=column 1, C2=column 2, C3=column 3, C4=column 4, C5=column 5, R1=row 1, R2=row 2, and R3=row 3. The multiple symbol positions in symbol-display-portion 402 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 4, C2 is between C1 and C3, C3 is between C2 and C4, and C4 is between C3 and C5.

For a matrix arrangement with 15 symbol positions as shown in FIG. 4, the numerical identifiers can be whole numbers 1 through 15, inclusive. The processors or machines described herein can be configured to select a symbol position of symbol-display-portion 402 using a random number generator that is configured to generate a number within the range 1 through N, inclusive, where N equals the number of symbol positions in symbol-display-portion 402. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 404 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 410, the determined payout amount to be displayed by the payout amount indicator 406, the determined credit balance to be displayed by the credit balance indicator 408, and the number of awarded remaining outcome events to be displayed by the outcome event counter 405.

Figure 5:
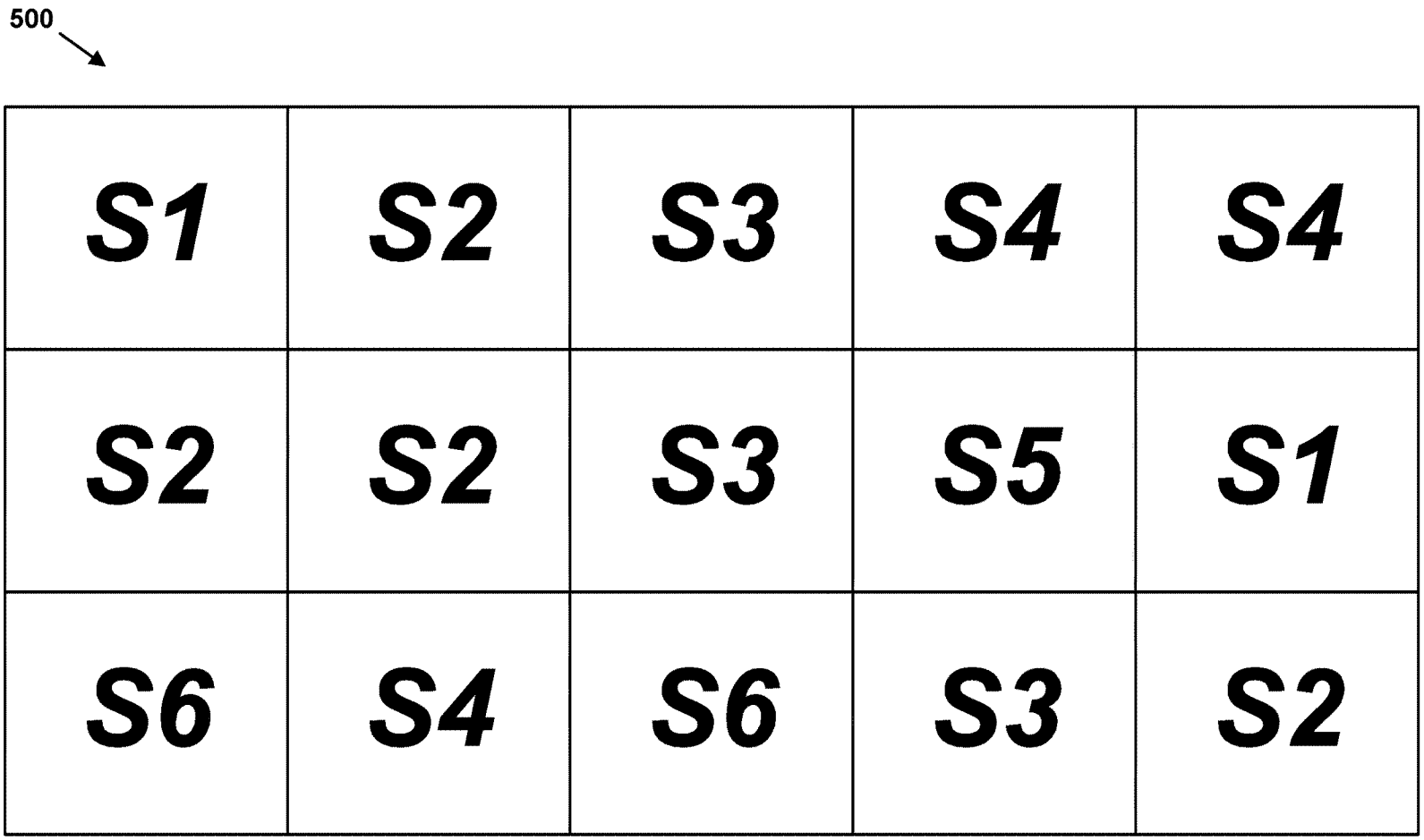
FIG. 5 depicts an example of a selected symbol set in a display, in accordance with example embodiments.

FIG. 5 shows an example of a selected symbol set 500 from the global symbol group for display during a base or bonus outcome event. The selected symbol set 500 includes (i) symbol S1 at arrangement positions C1,R1 and C5,R2, (ii) symbol S2 at arrangement positions C2,R1, C1,R2, C2,R2, and C5,R3, (iii) symbol S3 at arrangement positions C3,R1, C3,R2, and C4,R3, (iv) symbol S4 at arrangement positions C4,R1, C5,R1, and C2,R3, (v) symbol S5 at arrangement position C4,R2, and (vi) symbol S6 at arrangement positions C1,R3 and C3,R3. Other arrangements of symbols, in terms of the number of columns, number of rows, or the layout of symbols, are possible.

III. Example Reel-Based Bonus Game

FIG. 6A, FIG. 6B, FIG. 6C, and FIG. 6D (i.e., FIGS. 6A-6D) depict a flow chart showing a set of operations 645 (or more simply, "the set 645") that can, for example, be carried out using machine 100. Nonetheless, some or all of these operations may be carried out on server machine 100*a* and/or client machine 100*b*.

The operations of the set 645 are shown within blocks labeled with even integers between 600 and 638, inclusive, and can pertain to a method in connection with machine 100. The example method can relate to performing outcome events, such as a wager game. Any other operation(s) described herein as being performed by machine 100 can be performed prior to, while, or after performing any one or more of the operations of the set 645, unless context clearly dictates otherwise. Those other operation(s) can be performed in combination with or separately from any one or more of the operations of the set 645. Any operation described below, or elsewhere in this description, with respect to FIGS. 6A, 6B, 6C, and 6D, can be performed, at least in part, by a processor, such as processor 112 executing software program instructions.

Figure 6A:
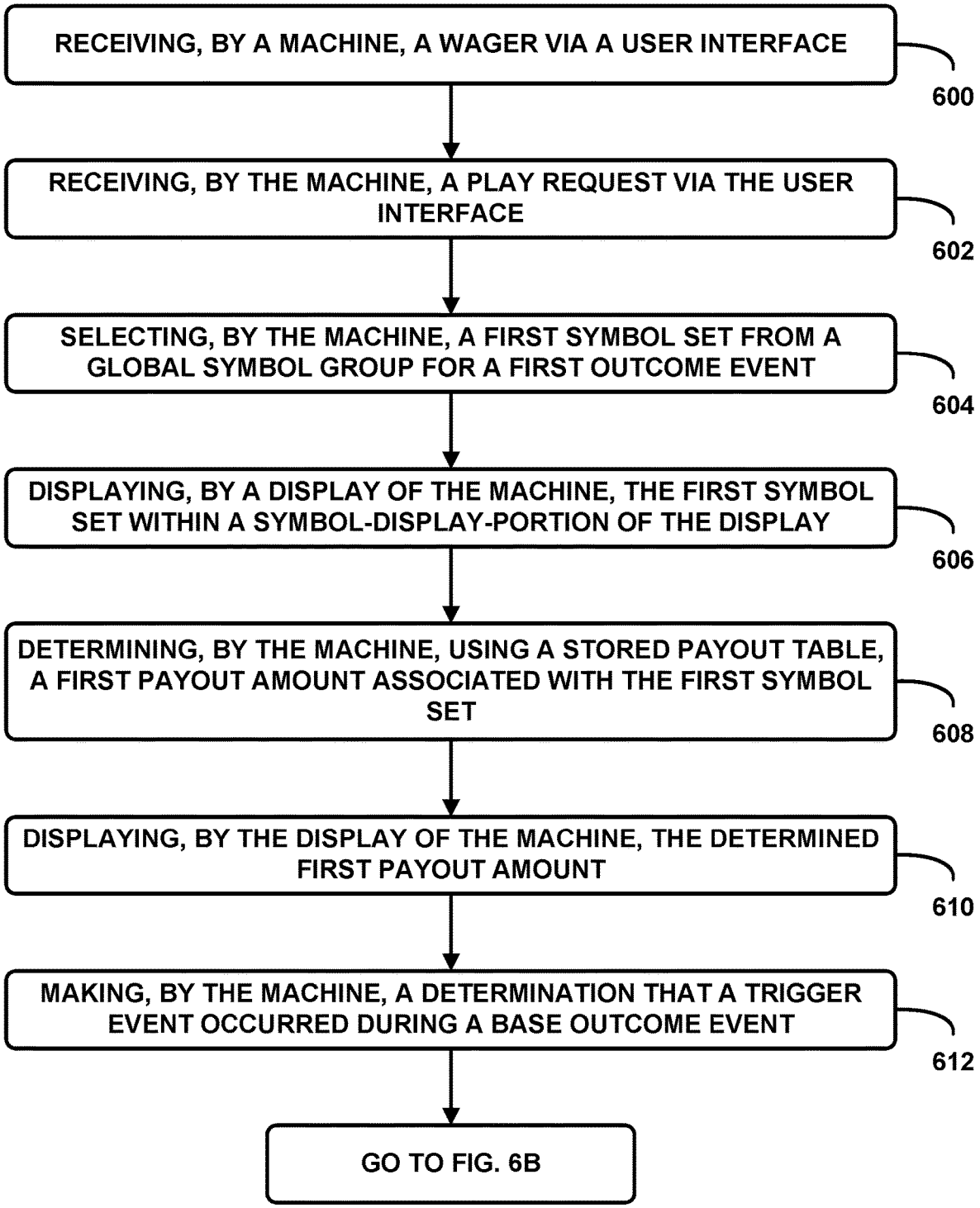
FIG. 6A is a first part of a flow chart, in accordance with example embodiments.

Turning to FIG. 6A, block 600 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 408, possible wager amounts in wager amount indicator 410, and a received wager amount in wager amount indicator 410.

Next, block 602 includes receiving, by machine 100, a play request (e.g., a "spin" request) via the user interface 104. Receiving the play request may involve or allow a player to pull a lever or push a button on machine 100 to initiate occurrence of an outcome event or to request a play of the wager game. Receiving the play request can result in the player's credit balance being reduced by an amount of the player's wager or payment to carry out the outcome event.

Next, block 604 includes selecting, by machine 100, a first symbol set to display within the symbol-display-portion 402 of display 110 for the outcome event. Determining the first symbol set can include processor 112 carrying out a random selection, such as a random selection of the first symbol set from a global symbol group, as described with respect to FIG. 3.

Next, block 606 includes displaying, by the machine 100 on the symbol-display-portion of the display 110, the selected first symbol set. FIG. 5 shows an example of a first symbol set 500 from the global symbol group for display during a base outcome event.

Next, block 608 includes determining, by machine 100, using a stored payout table (not shown), a first payout amount, where the first payout amount is a function of the selected first symbol set and the received wager. Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set.

Next, block 610, includes displaying, by display 110 of machine 100, the determined first payout amount. For example, where machine 100 has determined, using the stored payout table, a first payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

Next, block 612 includes making, by machine 100, a determination that a trigger event occurred during the base outcome event. The trigger event can be a randomly occurring event, such as an event that randomly occurs during performance of at least some base outcome events. For example, occurrence of the trigger event can include the presence of at least one trigger symbol in the first symbol set, such as in connection with a previous play of the game (e.g., a base outcome event). Similar to the selection of the first symbol set, in one example, machine 100 may use a random number generator to select the trigger symbol from the global symbol group. In another example, the trigger symbol may be non-randomly selected, such as selected by a user (e.g. a player, machine designer or casino personnel). In another example, the trigger symbol may be predetermined, for example a WILD symbol.

Making the determination that the trigger event occurred can take place while machine 100 operates in a first machine state (or more simply, the first state). Machine 100 can be configured such that, while machine 100 is operating in the first state, machine 100 allows the player to play base outcome events in which sets of symbols selected from a global symbol group can be selected by processor 112 and displayed by display 110.

Figure 6B:
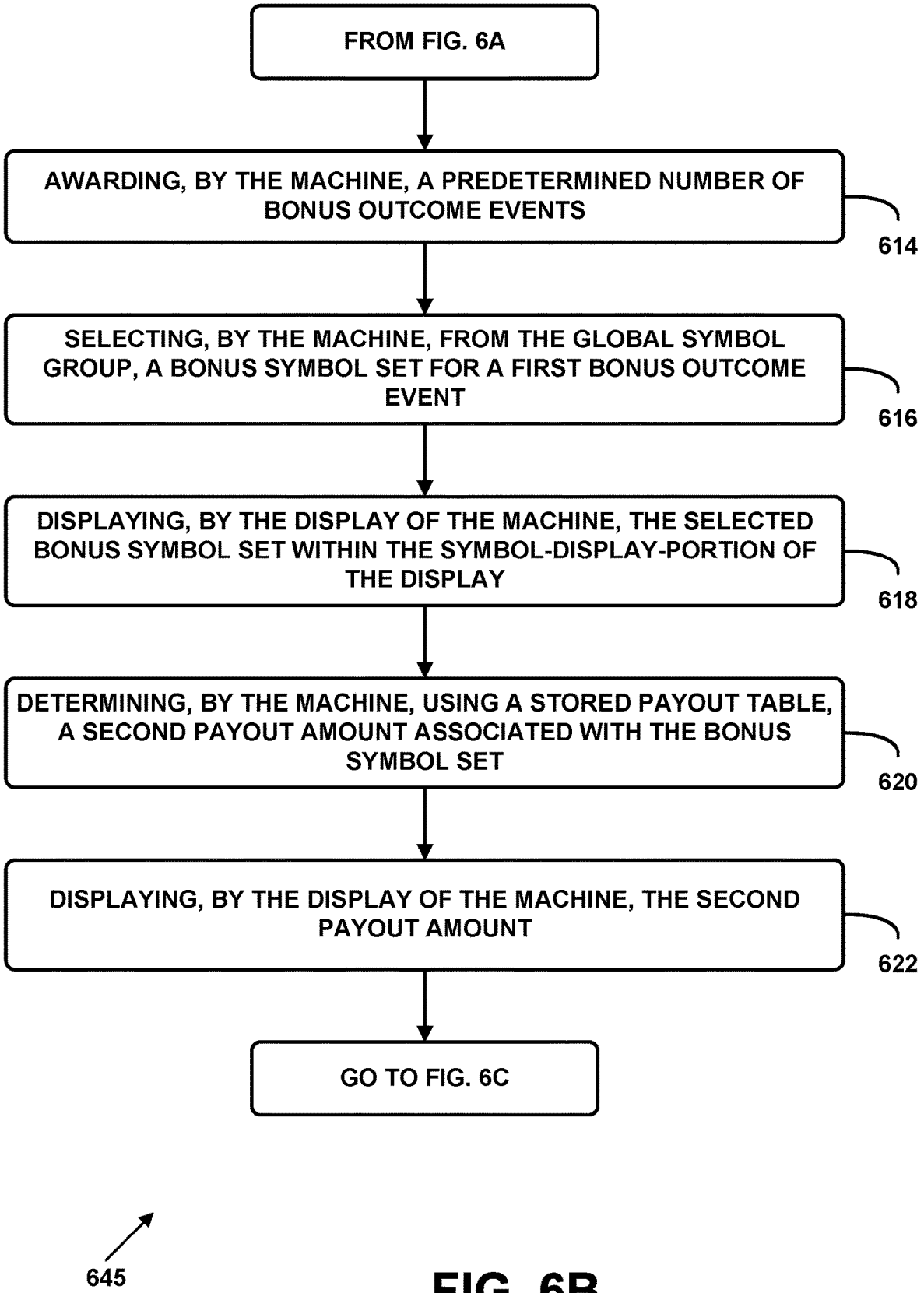
FIG. 6B is a second part of the flow chart of FIG. 6A, in accordance with example embodiments.

Turning to FIG. 6B, block 614 includes, responsive to machine 100 making the determination (i.e., the determination made at block 612), awarding, by machine 100, a bonus feature of the game. For example, the bonus feature may be a predetermined number of consecutive plays (e.g., spins and/or patterns of symbols being displayed) of outcome events. The awarded outcome events can be bonus outcome events, such as a game or a wager game. The predetermined number of consecutive outcome events can be conditioned upon a combination of symbols displayed by display 110 as a result of playing a base outcome event. Machine 100 can cause outcome event identifier 404 to identify the bonus outcome event awarded (e.g., a "free spins" bonus) and to cause the outcome event counter 405 to display the predetermined number.

Furthermore, in response to making the determination at block 612, machine 100 can transition from operating in the first state to operating in a second machine state (or more simply, the second state). Machine 100 can be configured such that, while machine 100 is operating in the second state, machine 100 allows the player to play bonus outcome events in which sets of symbols selected from a global symbol group can be selected by processor 112 and displayed by display 110. In accordance with an embodiment in which the symbol-display-portion includes 15 symbol positions, selecting a set of symbols for a bonus outcome event can include selecting 15 symbols.

Machine 100 can be configured to transition from operating in the second state back to operating in the first state. This transition can occur in response to machine 100 determining any of a variety of trigger events, such as, but not limited to, occurrence of all of the awarded predetermined number of consecutive plays of the outcome event, or a player stopping play of machine 100 while one or more of the awarded predetermined number of consecutive plays of the outcome event remain to occur. Machine 100 can be configured to store a number indicating any remaining consecutive plays of the outcome event and to allow a player awarded the consecutive plays to commence playing any remaining consecutive plays of the outcome event at a time after the player stops performing (e.g., playing) the outcome events.

Next, block 616 includes selecting, by the machine 100 from the global symbol group, a bonus symbol set for a first bonus outcome event.

Figure 7:
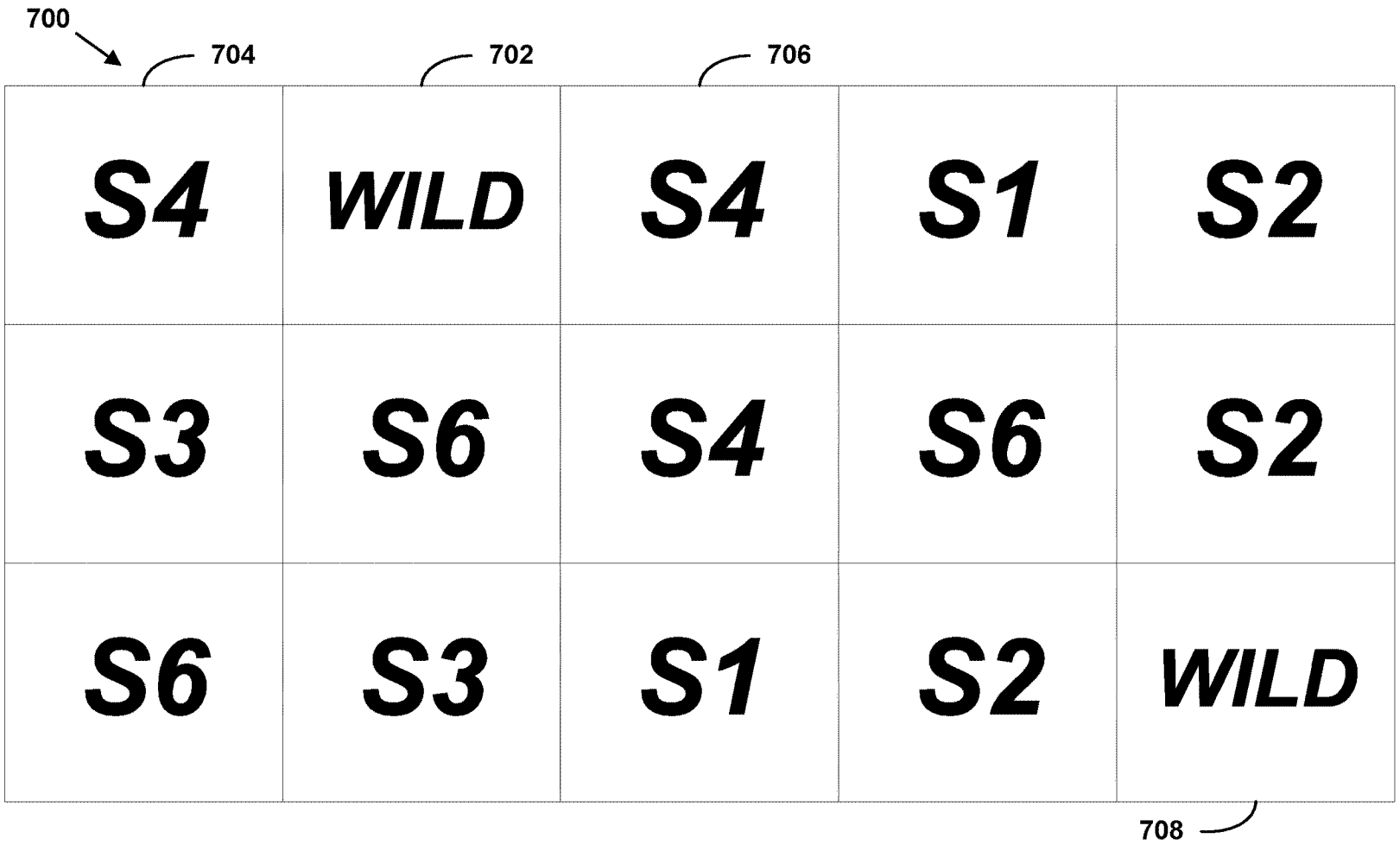
FIG. 7 depicts an example of a selected bonus symbols set in a display, in accordance with example embodiments.

Next, block 618 includes displaying, by the machine 100 on the symbol-display-portion of the display 110, the selected bonus symbol set. FIG. 7 shows an example of such a bonus symbol set 700 selected from the global symbol group. The bonus symbol set 700 consists of (i) two WILD symbols at arrangement positions C2,R1 and C5,R3; (ii) two S3 symbols at arrangement positions C1,R2 and C2,R3; (iii) two S1 symbols at arrangement positions C4,R1 and C3,R3; (iv) three S4 symbols at arrangement positions C1,R1, C3,R1, and C3,R2; (v) three S2 symbols at arrangement positions C5,R1, C5,R2, and C4,R3; and (vi) three S6 symbols at arrangement positions C2,R2, C4,R2, and C1,R3.

Next, block 620 includes determining, by machine 100, a second payout amount. In one example, the second payout amount may be determined by the machine 100 using a stored payout table (not shown) as a function of the received wager and the symbols in the displayed bonus symbol set.

Next, block 622 includes displaying, on the display 110, the determined second payout amount. In one example, the machine 100 may also physically dispense a corresponding payout amount (e.g., cash), or otherwise facilitate the payout to the player (e.g., by adding funds to an electronic account associated with a gaming card).

Figure 6C:
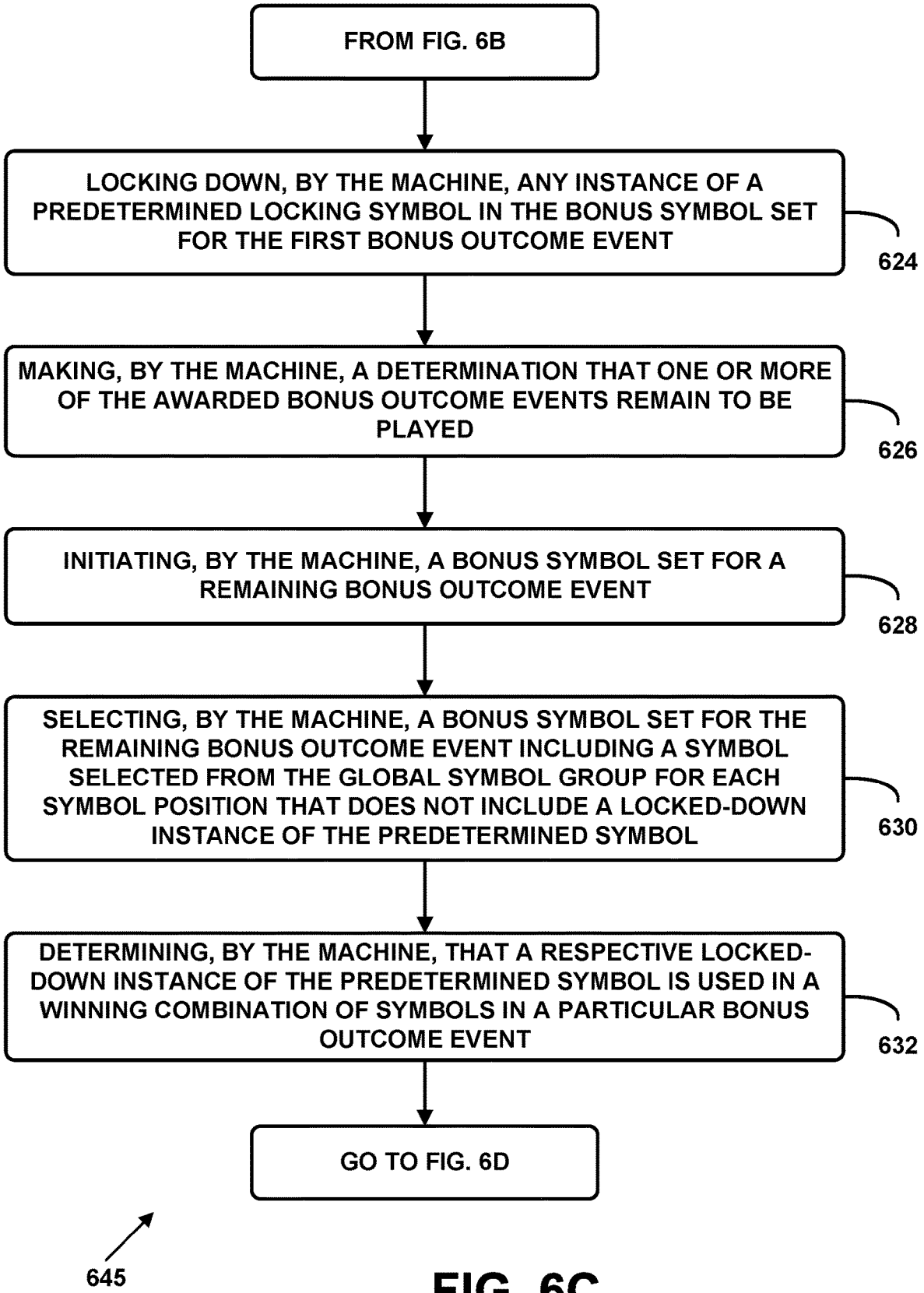
FIG. 6C is a third part of the flow chart of FIG. 6A, in accordance with example embodiments.

Turning to FIG. 6C, block 624 includes locking down, by machine 100, any instance of a predetermined symbol in the displayed bonus symbol set. Instances of the predetermined symbol may initially be locked down regardless of whether the predetermined symbols do or do not form part of a winning symbol combination (i.e., a symbol combination that qualifies for a payout). A particular instance of the predetermined symbol may be locked down until the particular instance has been used in n winning combinations of symbols of the bonus outcome events. As an example, processor 112 may execute program instructions to "lock down" any instance of the predetermined symbol until it has been used in three winning combinations of symbols (e.g., n=3). Each respective locked-down symbol may persist in the same arrangement position of the symbol-display-portion of the display 110 until the respective locked-down symbol has been a part of n winning bonus outcome events.

Next, block 626 includes making, by machine 100, a determination that one or more of the awarded bonus outcome events remain to be played. In that regard, processor 112 may determine that one or more awarded bonus outcome events have not occurred by referring to data within data storage 114 that is displayed at bonus outcome event counter 405 shown in FIG. 4. An awarded bonus outcome event that has not yet occurred can be referred to as a "remaining bonus outcome event."

Next, block 628 includes initiating, by machine 100, a remaining bonus outcome event. Initiating the remaining bonus outcome event can include selecting, at block 630, a bonus symbol set to display within the symbol-display-portion 116 of display 100. The bonus symbol set can include a symbol selected from the global symbol group for each arrangement position within the symbol-display-portion (i.e., when no predetermined locking symbol persists from previous iterations of the bonus game). Alternatively, the bonus symbol set can include a symbol selected from the global symbol group for each arrangement position within the symbol-display-portion 116 excluding each arrangement position with a locked down instance of the predetermined symbol.

Next, block 632 includes determining, by the machine 100, that a respective locked-down instance of the predetermined symbol is used in a winning combination of symbols in a particular bonus outcome event. In that regard, processor 112 may determine that the respective locked-down instance of the predetermined symbol is included in a winning pay line. In general, a locked-down instance of the predetermined symbol may be used in a winning combination of symbols in any bonus outcome even during which the locked-down instance of the predetermined symbol is present (i.e., while the instance of the predetermined symbol is locked down). In particular, the locked-down instance of the predetermined symbol may be used in a winning combination of symbols in a first bonus outcome event in which the locked-down instance of the predetermined symbol is first locked down. Additionally, the locked-down instance of the predetermined symbol may be used in a winning combination of symbols in bonus outcome events subsequent to the first bonus outcome event. Thus, a predetermined symbol may be locked down as soon as it appears as part of a bonus outcome event and may persist until it has been used as part of n winning combinations of symbols.

Figure 6D:
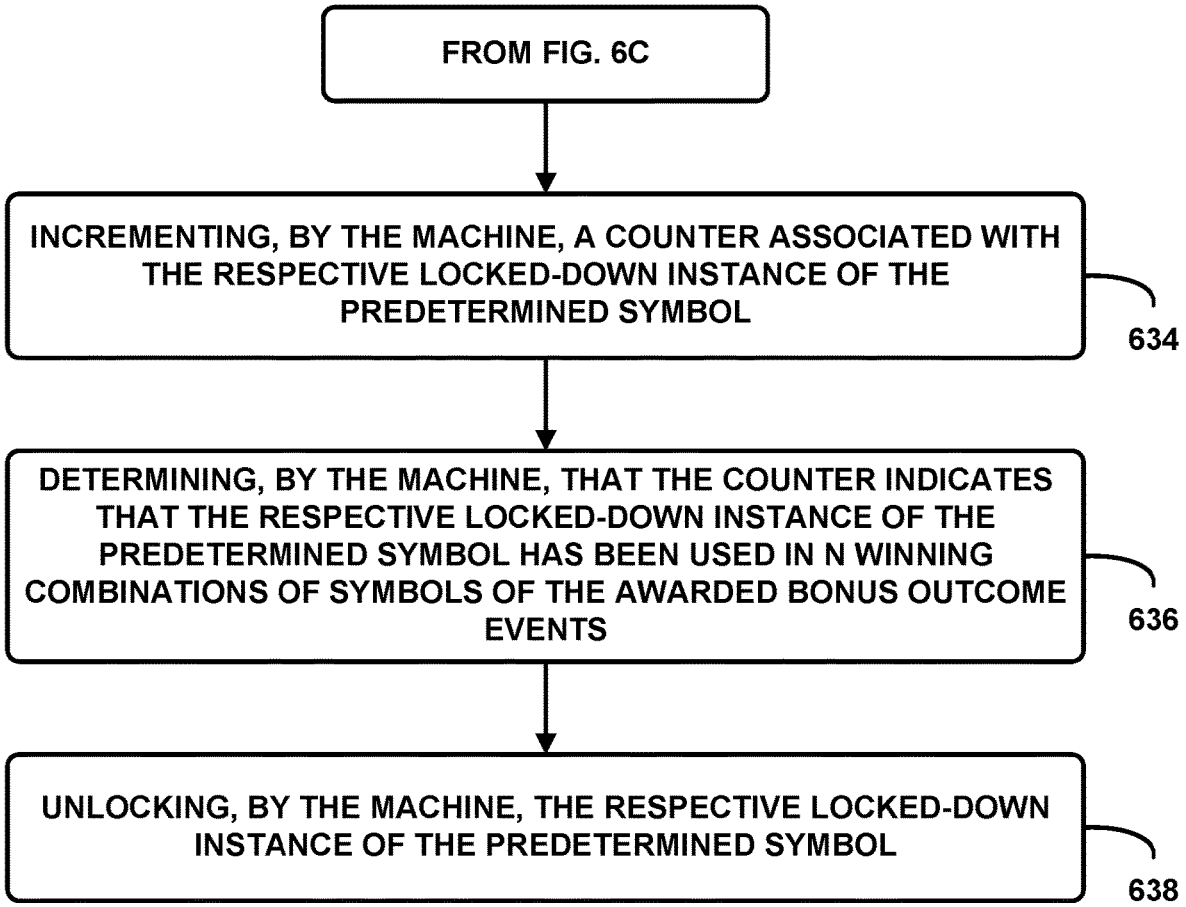
FIG. 6D is a fourth part of the flow chart of FIG. 6A, in accordance with example embodiments.

Turning to FIG. 6D, block 634 includes incrementing, by the machine 100, a counter associated with the respective locked-down instance of the predetermined symbol. The counter may be incremented by one each time the respective locked-down instance of the predetermined symbol is used in a winning combination of symbols of a bonus outcome event. In particular, the counter may be stored in data storage 114 which may be updated by processor 112 to increment the value of the counter.

Next, block 636 includes determining, by the machine 100, that the counter indicates that the respective locked-down instance of the predetermined symbol has been used in n winning combinations of symbols of the awarded bonus outcome events. In this regard, processor 112 may compare the counter value, stored in data storage 114, associated with the respective locked-down instance of the predetermined symbol to the value of n. The value of n may vary among example implementations. In one example embodiment, the value of n may be equal to 3.

Next, block 638 includes unlocking, by the machine 100, the respective locked-down instance of the predetermined symbol. The unlocked predetermined symbol may be replaced in any subsequent iteration of the bonus outcome events remaining to be played. The unlocked predetermined symbol may be replaced by a symbol from the global symbol group other than a predetermined symbol. Alternatively, the unlocked predetermined symbol may be replaced by another predetermined symbol that is again locked down, as in block 624.

Functions of the set 645 can repeat to carry out each remaining bonus outcome event in response to machine 100 making the determination of block 626.

In one example, the predetermined symbol may be a WILD symbol. In particular, as shown in FIG. 7, WILD symbol 702 and the two S4 symbols 704 and 706 in the bonus symbol set 700 form part of an example winning symbol combination (i.e., three S4 symbols in a row since the WILD symbol 702 can substitute for any other symbol in the global symbol group).

The example winning symbol combinations are provided herein for illustrative purposes. Additional winning symbol combinations not explicitly enumerated herein may be possible. For example, in some implementations, the S4 symbol at position C3, R2 may form part of the winning combination that includes symbols 704, 702, and 706. The example embodiments herein described may operate regardless of the possible symbol patterns used to form winning combinations.

WILD symbol 702 may be locked down and may persist in a bonus symbol set selected for a next one of the awarded bonus outcome events that remain to occur. Notably, WILD symbol 702 may be locked down regardless of whether it does or does not form part of a winning combination. Additionally, the counter associated with WILD symbol 702 may be incremented to indicate that WILD symbol 702 has been part of one winning combination.

WILD symbol 708, on the other hand, does not form part of a winning symbol combination. Nevertheless, WILD symbol 708 may likewise be locked down and may persist in the bonus symbol set selected for the next one of the awarded bonus outcome events that remain to occur. However, the counter associated with WILD symbol 708 is not incremented since WILD symbol 708 does not form part of a winning symbol combination.

Figure 8:
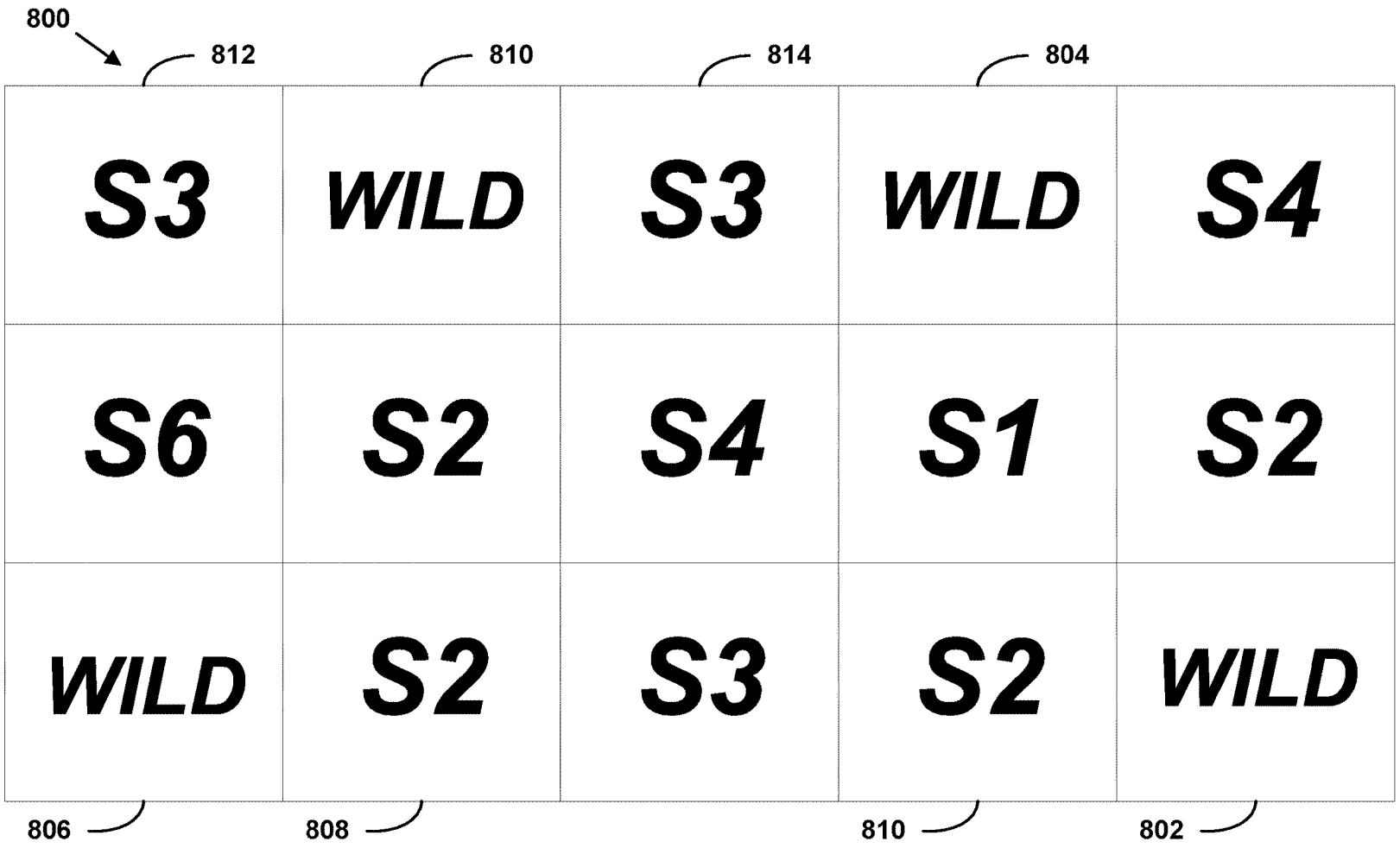
FIG. 8 depicts an example of another selected bonus symbols set in a display, in accordance with example embodiments.

FIG. 8 shows an example of another bonus symbol set 800 selected from the global symbol group for displaying during a remaining (e.g., a next) bonus outcome event occurring after the outcome event represented by FIG. 7. As described above, the remaining outcome events discussed with respect to FIG. 8 can be initiated pursuant to machine 100 making a determination that one or more of the awarded bonus outcome events have not yet occurred (i.e., remain to occur). For brevity of example, the descriptions of FIG. 7, FIG. 8, and FIG. 9 assume that n=2.

Bonus symbol set 800 includes four WILD symbols 802, 804, 806, and 810 at respective arrangement positions C5,R3, C4,R1, C1,R3, and C2,R1. WILD symbols 802 and 810 have persisted from the previous bonus symbol set 700 in the same arrangement positions. WILD symbol 810 has been used as part of one winning combination. WILD symbol 802 has not yet been used as part of a winning symbol combination. WILD symbols 804 and 806 have been newly selected as part of the bonus symbol set 800.

WILD symbols 802 and 806, together with the two S2 symbols in the bonus symbol set 800 represented in FIG. 8 form part of a winning symbol combination (i.e., four S2 symbols since the WILD symbols 802 and 806 can substitute for any other symbol in the global symbol group). The respective counters associated with WILD symbols 802 and 806 may be incremented to indicate that WILD symbols 802 and 806 have each been part of one winning combination.

Similarly, WILD symbols 810 and 804, together with the two S3 symbols 812 and 814 form part of a winning symbol combination (i.e., four S3 symbols in a row since the WILD symbols 810 and 804 can substitute for any other symbol in the global symbol group). The respective counters associated with WILD symbols 810 and 804 may be incremented to indicate that WILD symbol 810 has been part of two winning combinations and WILD symbol 804 has been part of one winning combination. Accordingly, since n=2 and WILD symbol 810 has been part of two winning combinations, WILD symbol 810 may be unlocked. WILD symbols 804, 806, and 810 have only been part of one winning combination each and will thus persist onto a subsequent iteration of the bonus game.

Figure 9:
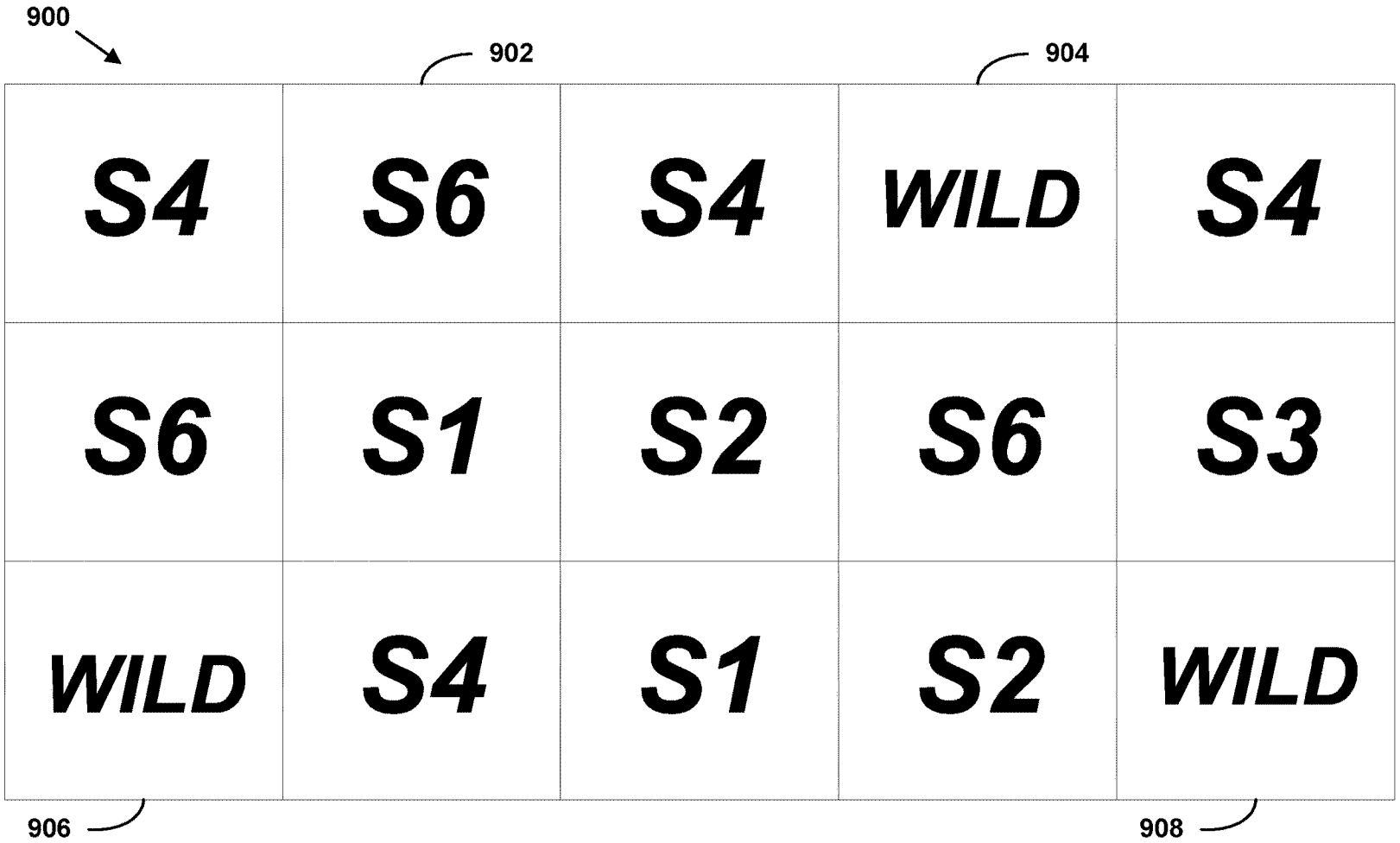
FIG. 9 depicts an example of a further selected bonus symbols set in a display, in accordance with example embodiments.

FIG. 9 shows a further example of another bonus symbol set 900 selected from the global symbol group for displaying during a remaining (e.g., a next) bonus outcome event occurring after the outcome event represented by FIG. 8. WILD symbol 810 of FIG. 8 has been unlocked and thus no longer persists in bonus symbol set 900. WILD symbol 810 has been replaced by symbol S6. However, in some embodiments, it is possible for WILD symbol 810 to be replaced with a new WILD symbol that is locked down at position C2,R1. WILD symbols 904, 906, and 908 persist from prior iterations of the bonus game since the counter associated with each of the WILD symbols indicates that each WILD symbol has formed part of one winning combination (and n=2). The operations described with respect to FIG. 7 and FIG. 8 may again be repeated for bonus symbol set 900 to determine winning outcomes and update the respective counters associated with locked-in WILD symbols in symbol set 900. For example, the counter associated with WILD 904 may be incremented to two and WILD symbol 904 may thus be unlocked for subsequent iterations of the bonus game. WILD symbol 904 may be replaced by another WILD or non-WILD symbol in the subsequent iterations of the bonus game.

Notably, the operations of replacing, reordering, adding, and/or removing symbols from a reel of a reel-based game (e.g., the operations of blocks 624-638, as just some possible examples), necessitate computer implementation. In a mechanical reel-based game, the symbols appearing on each reel are fixed and cannot be changed mid-game. In contrast, the computer implementation herein allows the number of symbols per reel to be changed, as well as the symbols appearing on each reel to be replaced and/or re-ordered and/or to be changed during a game based on cross-dependency with the symbols of other reels. These changes can occur mid-game, for example between spins of the reels or at the end of a game, for example after a spin and based on the symbols identified for the different reels. Consequently, these features of the disclosure herein would not exist but for computer technology.

Particularly, the embodiments herein solve a technical problem of how to add movement to individual symbols of a reel-based game and further unpredictability in the reel-based game. The operations of replacing, reordering, adding, and/or removing symbols from a reel would be prohibitively complex and expensive to implement on a traditional machine with mechanical reels. In effect, the present approach can be seen as providing an implementation which increases the number and variety of possible outcomes in a random selection of data entries based on a reel-based game of luck.

For example, embodiments that involve selecting a set of symbols that includes an instance of the predetermined locking symbol when the instance of the predetermined locking symbol was locked in place from a previous iteration of the bonus game and has been used in fewer than n winning combinations of symbols in the bonus game, or when the instance of the predetermined locking symbol was initially selected during the respective iteration of the bonus game clearly involve a computerized implementation. In particular, computerized implementation is necessitated because when an instance of the predetermined locking symbol, located on a particular reel, is locked down in a fixed position of the symbol-display-portion, the remaining symbols on the particular reel continue to spin. In a traditional machine with mechanical reels, locking down a single symbol on a given reel would result in the remaining symbols on the given reel also being locked down. Thus, to allow individual symbol locking, a computerized implementation is necessary to allow for replacing, reordering, adding, and/or removing of individual symbols on each of the reels.

Further, these features are an improvement to reel-based gaming technology. Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

IV. Example Operations

FIGS. 10A-10D depict a flow chart showing a set of operations 1000 (or more simply, "the set 1000") that can, for example, be carried out using server machine 100*a*. Note that several of the operations described in connection with FIGS. 10A-10D parallel operations described in connection with FIGS. 6A-6D. As such, variations of the operations described in connection with FIGS. 6A-6D are likewise applicable to the operations described in connection with FIGS. 10A-10D. However, for the sake of brevity, these variations are not repeated. The server machine 100*a*, in performing the set 1000, can perform the operations described above with respect to machine 100.

Figure 10A:
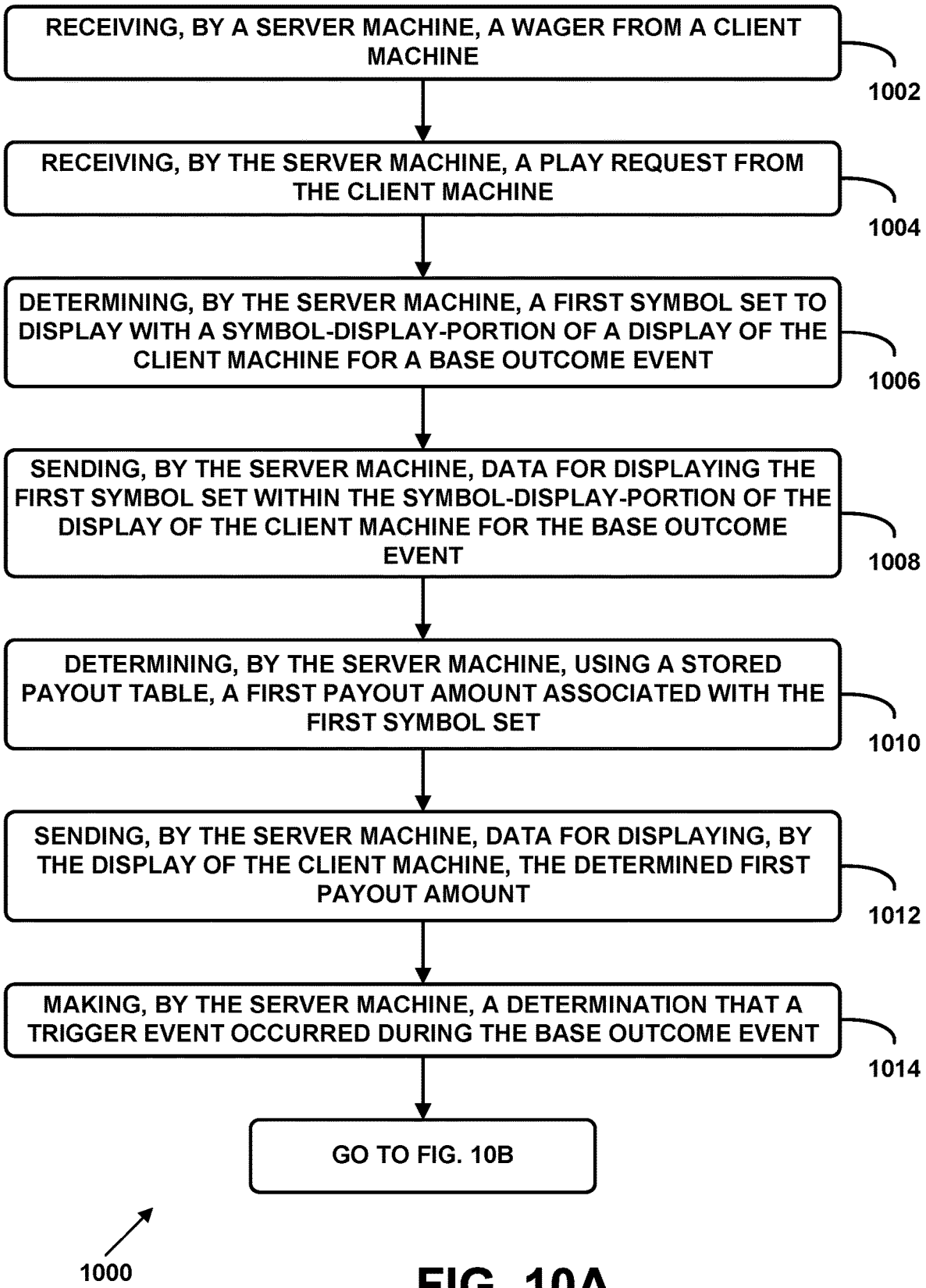
FIG. 10A is a first part of a flow chart, in accordance with example embodiments.

Turning to FIG. 10A, block 1002 includes receiving, by the server machine 100*a*, a wager from the client machine 100*b*.

Next, block 1004 includes receiving, by the server machine 100*a*, a play request from the client machine 100*b*.

Next, block 1006 includes determining, by the server machine 100*a*, a first symbol set to display within the symbol-display-portion of the display 110*b* of the client machine 100*b* for a base outcome event.

Next, block 1008 includes sending, by the server machine 100*a*, data for displaying, by the display 110*b* of the client machine 100*b*, the first symbol set within the symbol-display-portion of the display.

Next, block 1010 includes determining, by the server machine 100*a* using a stored payout table, a first payout amount associated with the first symbol set.

Next, block 1012 includes sending, by the server machine 100*a*, data for displaying, by the display 110*b* of the client machine 100*b*, the determined first payout amount.

Next, block 1014 includes making, by the server machine 100*a*, a determination that a trigger event occurred during the base outcome event.

Figure 10B:
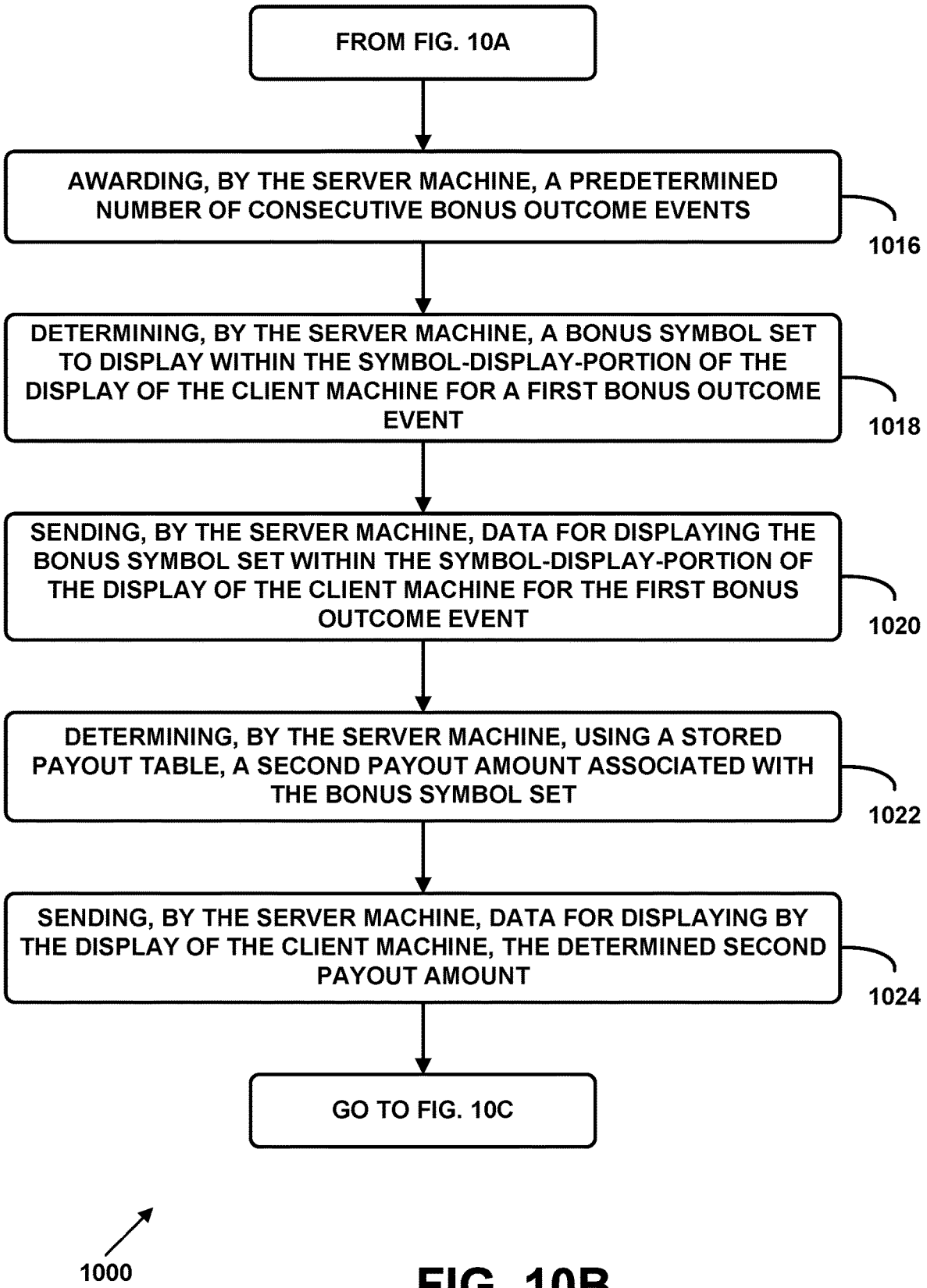
FIG. 10B is a second part of the flow chart of FIG. 10A, in accordance with example embodiments.

Turning to FIG. 10B, block 1016 includes awarding, by the server machine 100*a*, a predetermined number of consecutive bonus outcome events.

Next, block 1018 includes determining, by the server machine 100*a*, a bonus symbol set to display within the symbol-display-portion of the display 110*b* of the client machine 100*b* for a first bonus outcome event.

Next, block 1020 includes sending, by the server machine 100*a*, data for displaying, by the display 110*b* of the client machine 100*b*, the bonus symbol set within the symbol-display-portion of the display.

Next, block 1022 includes determining, by the server machine 100*a*, using a stored payout table, a second payout amount associated with the bonus symbol set.

Next, block 1024 sending, by the server machine 100*a*, data for displaying, by the display device 110*b* of the client machine 100*b*, the determined second payout amount.

Figure 10C:
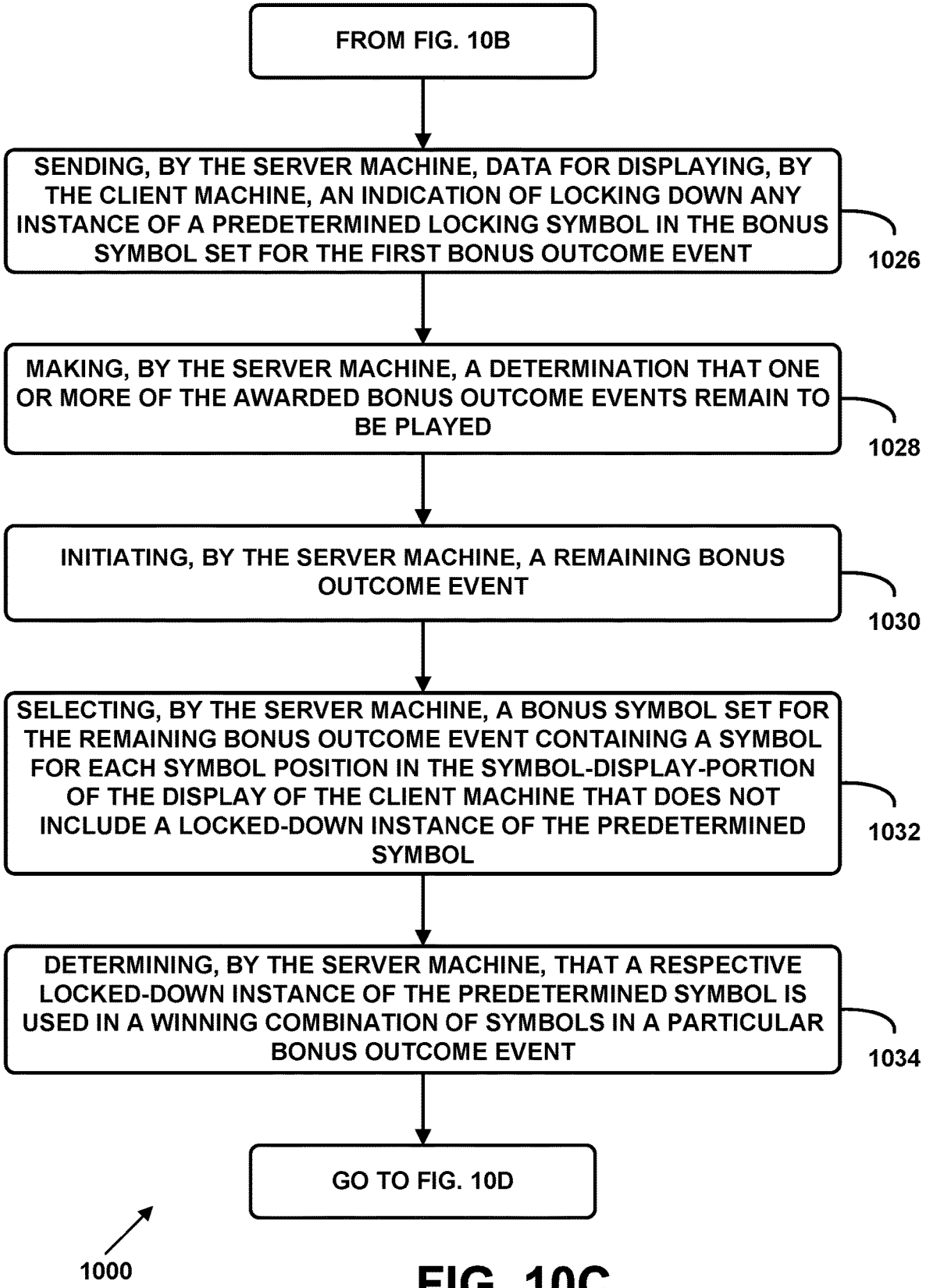
FIG. 10C is a third part of the flow chart of FIG. 10A, in accordance with example embodiments.

Turning to FIG. 10C, block 1026 includes sending, by the server machine 100*a*, data for displaying, by the display device 110*b* of the client machine 100*b*, an indication of locking down any instance of a predetermined locking symbol in the bonus symbol set for the first bonus outcome event. The indication of locking down any instance of the predetermined symbol may include an animation of the instance of the predetermined locking symbol freezing over.

Next, block 1028 includes making, by the server machine 100*a*, a determination that one or more of the awarded bonus outcome events remain to be played.

Next, block 1030 includes initiating, by the server machine 100*a*, a remaining one of the awarded bonus outcome events.

Next, block 1032 includes selecting, by the server machine 100*a*, a bonus symbol set for the remaining bonus outcome event. The bonus symbol set may contain a symbol for each symbol position in the symbol-display-portion of the display 110*b* of the client device 100*b* that does not already include a locked-down instance of the predetermined symbol.

Next, block 1034 includes determining, by the server machine 100*a*, that a respective locked-down instance of the predetermined symbol is used in a winning combination of symbols in a particular bonus outcome event.

Figure 10D:
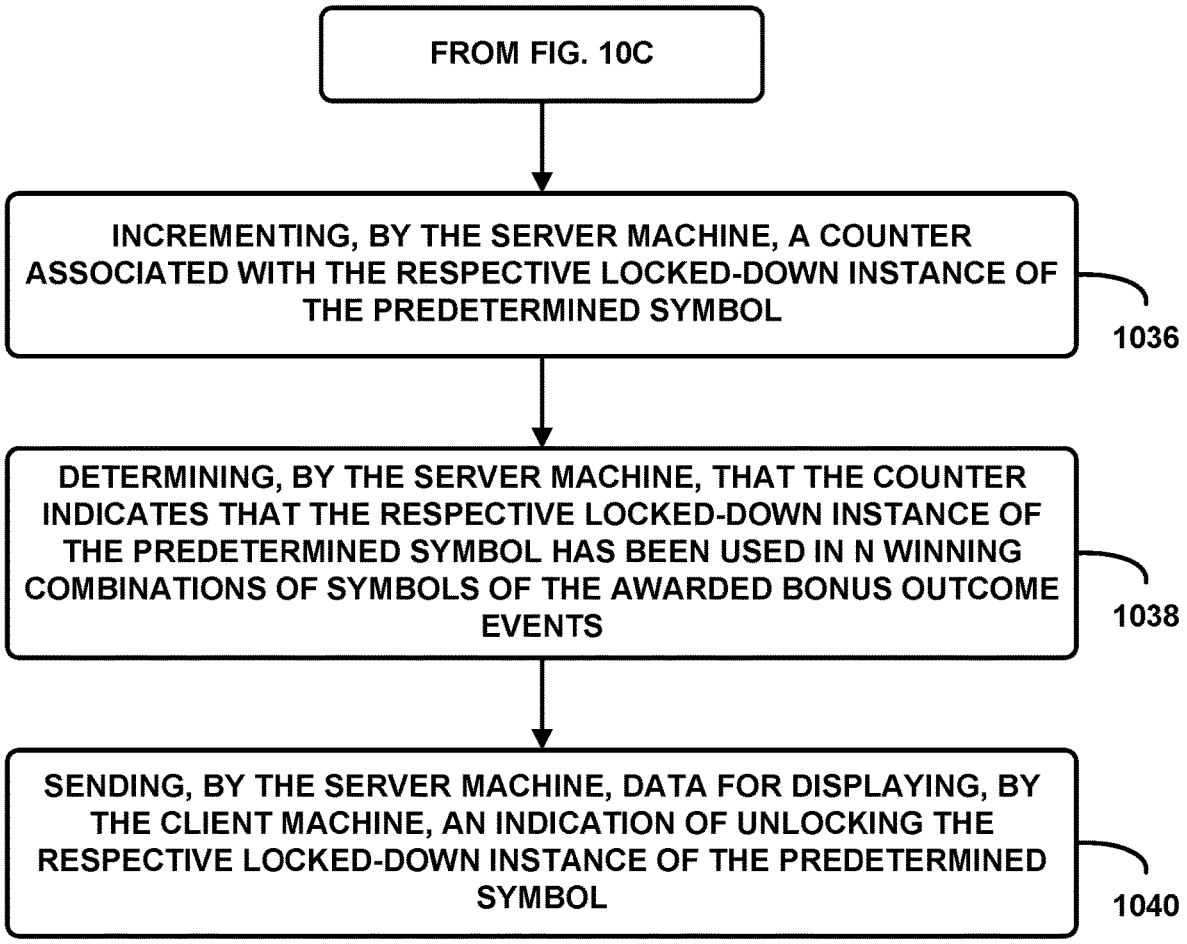
FIG. 10D is a fourth part of the flow chart of FIG. 10A, in accordance with example embodiments.

Turning to FIG. 10D, block 1036 includes incrementing, by the server machine 100*a*, a counter associated with the respective locked-down instance of the predetermined symbol. As the counter is incremented, server machine 100*a* may provide data for displaying, by the display device 110*b* the client machine 100*b*, an animation of the instance of the predetermined locking symbol gradually thawing out. The animation may provide a technical solution to indicating a remaining duration of a status condition while also allowing the status condition to be identified without obscuring display of the content of that status condition. In particular, the animation indicates a remaining lifetime of a respective locked-down instance of the predetermined locking symbol while enabling the display of the locked-down symbol itself to remain visible.

Next, block 1038 includes determining, by the server machine 100*a*, that the counter indicates that the respective locked-down instance of the predetermined symbol has been used in n winning combinations of symbols of the awarded bonus outcome events.

Next, block 1040 includes sending, by the server machine 100*a*, data for displaying, by the display device 110*b* the client machine 100*b*, an indication of unlocking the respective locked-down instance of the predetermined symbol. The indication of unlocking the respective locked-down instance of the predetermined symbol may include an animation of the instance of the predetermined locking symbol completely thawing out.

Figure 11A:
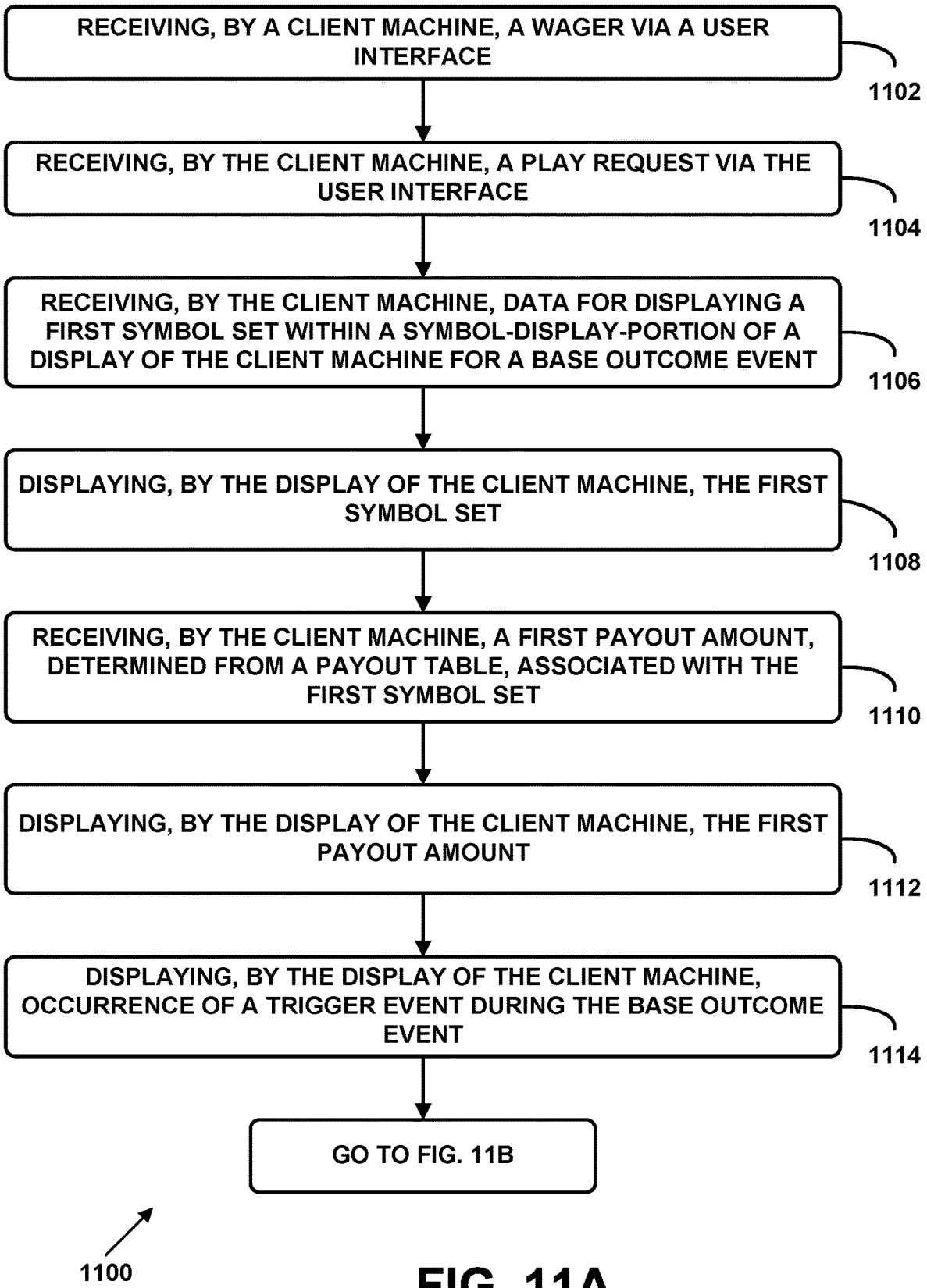
FIG. 11A is a first part of a flow chart, in accordance with example embodiments.
Figure 11B:
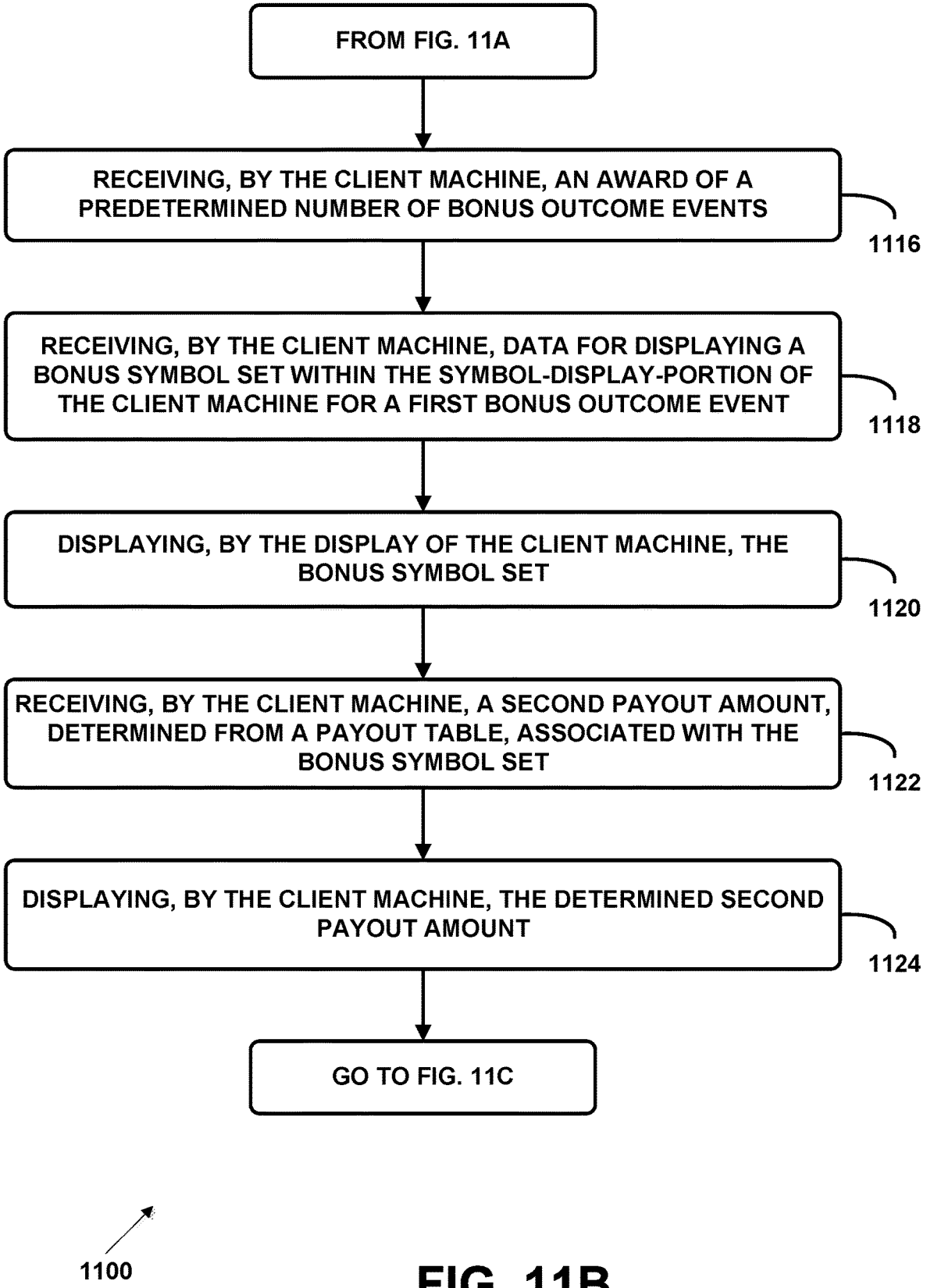
FIG. 11B is a second part of the flow chart of FIG. 11A, in accordance with example embodiments.
Figure 11C:
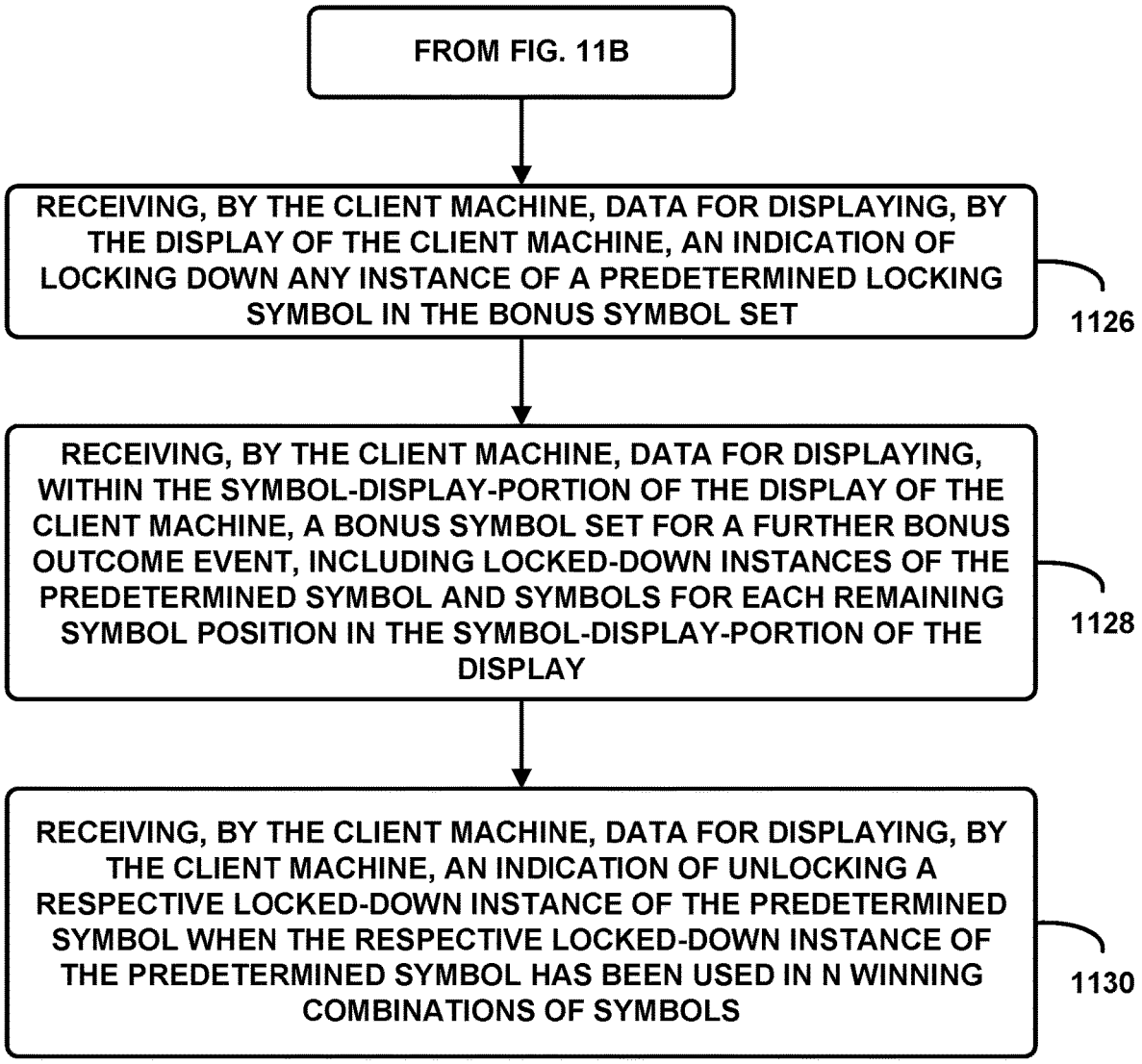
FIG. 11C is a third part of the flow chart of FIG. 11A, in accordance with example embodiments.

FIGS. 11A-11C depict a flow chart showing a set of operations 1100 (or more simply, "the set 1100") that can, for example, be carried out using client machine 100*b*. Note that several of the operations described in connection with FIGS. 11A-11C parallel operations described in connection with FIGS. 6A-6D and FIGS. 10A-10D. As such, variations of the operations described in connection with FIGS. 6A-6D and FIGS. 10A-10D are likewise applicable to the operations described in connection with FIGS. 11A-11C. However, for the sake of brevity, these variations are not repeated. The client machine 100*b*, in performing the set 1000, can perform the operations described above with respect to machine 100.

Turning to FIG. 11A, block 1002 includes receiving, by the client machine 100*b*, a wager via the user interface 104*b*. Client machine 100*b* can transmit the received wager or data indicative thereof over the communication network 116 to server machine 100*a*.

Next, block 1104 includes receiving, by the client machine 100*b*, a play request via the user interface 104*b*. Client machine 100*b* can transmit the received play request or data indicative thereof over the communication network 116 to server machine 100*a*.

Next, block 1106 includes receiving, by the client machine 100*b*, data for displaying a first symbol set within the symbol-display-portion of the display 110*b* for a first base outcome event.

Next, block 1108 includes displaying, by the display 100*b* of the client machine 100*b*, the first symbol set.

Next, block 1110 includes receiving, by the client machine 100*b*, a first payout amount, determined from a payout table, associated with the first symbol set.

Next, block 1112 includes displaying, by the display 110*b* of the client machine 100*b*, the determined first payout amount.

Next, block 1114 includes displaying, by the display 110*b* of the client machine 100*b*, occurrence of a trigger event during the base outcome event.

Turning to FIG. 11B, block 1116 includes receiving, by the client machine 100*b*, an award of a predetermined number of consecutive bonus outcome events.

Next, block 1118 includes receiving, by the client machine 100*b*, data for displaying a bonus symbol set within the symbol-display-portion of the client machine for a first bonus outcome event.

Next, block 1120 includes displaying, by the display 110*b* of the client machine 100*b*, the bonus symbol set.

Next, block 1122 includes receiving, by the client machine 100*b*, a second payout amount, determined from a payout table, associated with the bonus symbol set.

Next, block 1124 includes displaying, by the display 110*b* of the client machine 100*b*, the determined second payout amount.

Turning to FIG. 11C, block 1126 includes receiving, by the client machine 100*b*, data for displaying, within the symbol-display-portion of the display 110*b* of the client machine 100*b*, an indication of locking down any instance of a predetermined locking symbol in the bonus symbol set.

Next, block 1128 includes receiving, by the client machine 100*b*, data for displaying, within the symbol-display-portion of the display 110*b* of the client machine 100*b*, a bonus symbol set for a further bonus outcome event. This bonus symbol set may include locked-down instances of the predetermined symbol and symbols for each remaining symbol position in the symbol-display-portion of the display.

Next, block 1130 may include receiving, by the client machine 100*b*, data for displaying, by the display 110*b* of the client machine 100*b*, an indication of unlocking a respective locked-down instance of the predetermined symbol when the respective locked-down instance of the predetermined symbol has been used in n winning combinations of symbols.

Figure 12:
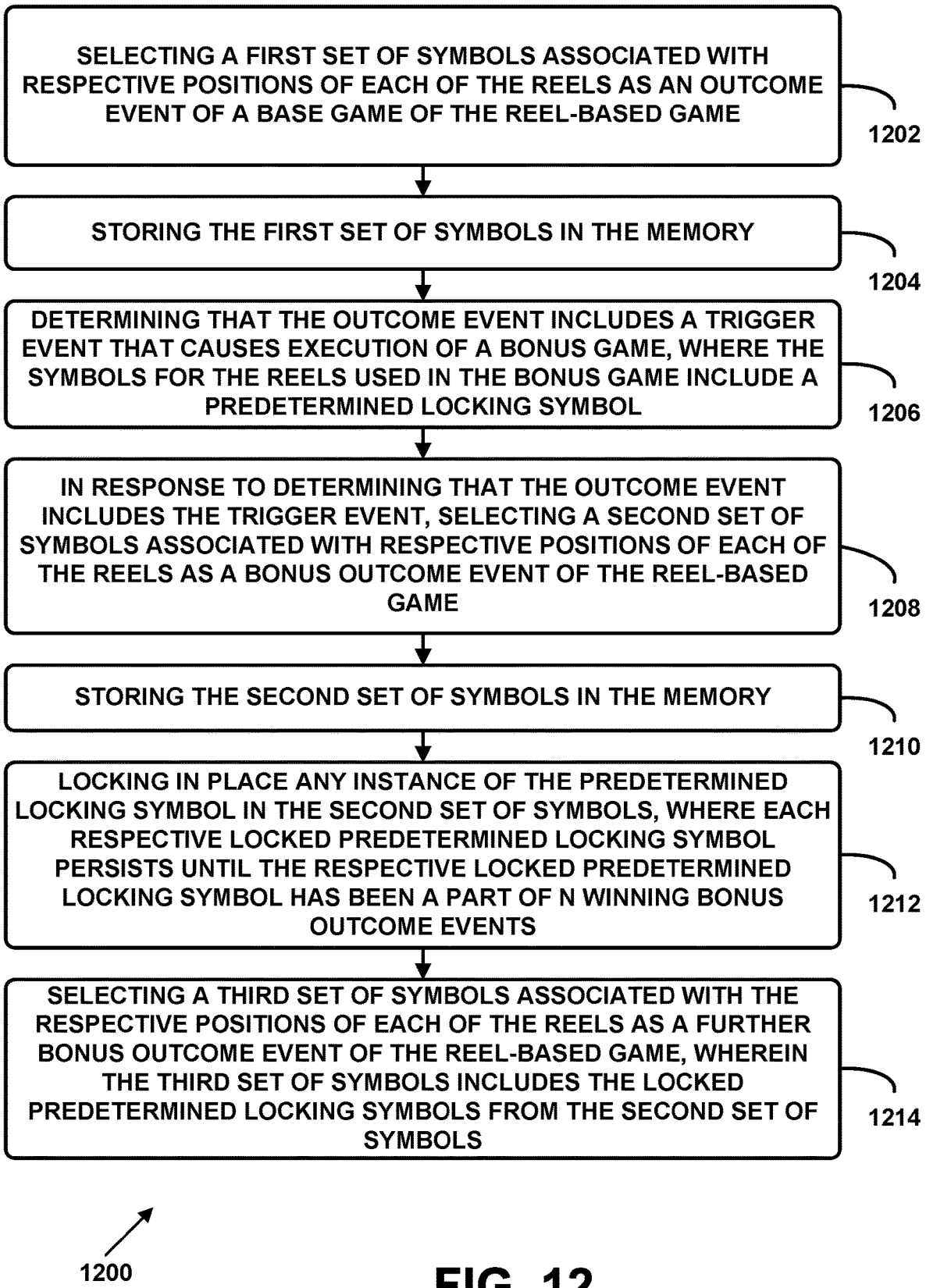
FIG. 12 is a flow chart, in accordance with example embodiments.

FIG. 12 depicts a flow chart showing a set of operations 1200 (or more simply, "the set 1200") that can, for example, be carried out using server machine 100*a* and/or client machine 100*b*. To the extent that a client machine carries out any of the set 1200, these operations may also include displaying various types of information, such as symbol sets, payout amounts, and so on. Note that several of the operations described in connection with FIG. 12 parallel operations described in connection with FIGS. 6A-6D, FIGS. 10A-10D, and FIGS. 11A-11C. As such, variations of the operations described in connection with FIGS. 6A-6D, FIGS. 10A-10D, and FIGS. 11A-11C are likewise applicable to the operations described in connection with FIG. 12.

Turning to FIG. 12, block 1202 includes selecting a first set of symbols associated with respective positions of each of the reels as an outcome event of a base game of the reel-based game.

Next, block 1204 includes storing the first set of symbols in the memory.

Next, block 1206 includes determining that the outcome event includes a trigger event that causes execution of a bonus game, where the symbols for the reels used in the bonus game include a predetermined locking symbol.

Next, block 1208 includes, responsive to determining that the outcome event includes the trigger event, selecting a second set of symbols associated with respective positions of each of the reels as a bonus outcome event of the reel-based game.

Next, block 1210 includes storing the second set of symbols in the memory.

Next, block 1212 includes locking in place any instance of the predetermined locking symbol in the second set of symbols. Each respective locked predetermined locking symbol may persist until the respective locked predetermined locking symbol has been a part of n winning bonus outcome events.

Next, block 1214 includes selecting a third set of symbols associated with the respective positions of each of the reels as a further bonus outcome event of the reel-based game. The third set of symbols may include the locked predetermined locking symbols persisting from the second set of symbols.

In some embodiments, a particular locked predetermined locking symbol may be unlocked after having been used in n winning combinations of symbols in the bonus game.

In some embodiments, a particular locked predetermined locking symbol may be unlocked. The unlocked predetermined locking symbol may be replaced in a subsequent iteration of the bonus game.

In some embodiments, n may be at least 2.

In some embodiments, the predetermined symbol may be a wild symbol that is substitutable for other symbols in the reel-based game.

In some embodiments, the selected third set of symbols may include two or more instances of the predetermined locking symbol. At least one of the two or more instances of the predetermined locking symbol may have been locked in place from the second set of symbols and at least one other of the two or more instances of the predetermined locking symbol may have been initially selected as part of the third set of symbols.

In some embodiments, it may be determined that the selected third set of symbols includes no new predetermined locking symbols and does not include a winning combination. In response to determining that the selected third set of symbols includes no new predetermined locking symbols and does not include the winning combination, the selected third set of symbols may be left in their previous respective locked or unlocked states.

In some embodiments, it may be determined that the counter indicates that the particular locked predetermined locking symbol has been used in n winning combinations of symbols in the bonus game. In response to determining that the counter indicates that the particular locked predetermined locking symbol has been used in n winning combinations of symbols in the bonus game, the particular locked predetermined locking symbol may be unlocked.

In some embodiments, each reel may include a respective cyclical sequence of symbols. Selecting the first set of symbols, the second set of symbols, and the third set of symbols may include, for each reel, randomly selecting a respective reel position that displays a subsequence of the symbols on the reel that are part of the first set of symbols, the second set of symbols, and the third set of symbols, respectively.

In some embodiments, selecting the first set of symbols, the second set of symbols, and the third set of symbols may include simulating a spin of all reels.

In some embodiments, at least one instance of the predetermined locking symbol may be present in the second set of symbols. The client machine may be caused to display an animation of the at least one instance of the predetermined locking symbol freezing over.

In some embodiments, at least one instance of the predetermined locking symbol may be present in the second set of symbols. At least one of the second set of symbols or the third set of symbols may include a winning symbol combination. The client machine may be caused to display an animation of the instance of the predetermined locking symbol partially thawing out in response to the winning symbol combination.

In some embodiments, an extent of frost surrounding the at least one instance of the predetermined locking symbol may be inversely proportional to a number of winning combinations of symbols in the bonus game in which the instance of the predetermined locking symbol has been used.

In some embodiments, the extent of frost may indicate a remaining lifetime of the at least one instance of the predetermined locking symbol while simultaneously displaying the instance of the predetermined locking symbol.

In some embodiments, the base game and the bonus game may have five reels and each of the five reels may display three symbols at a time.

In some embodiments, an animation of the plurality of reels spinning to select the third set of symbols may be displayed. Any locked predetermined locking symbols on the plurality of reels might not spin in the animation.

In some embodiments, the trigger event for the bonus game may include the base outcome event of the base game including at least k trigger symbols, where k may be at least 2.

In some embodiments, it may be determined that the second set of symbols or the third set of symbols includes a winning combination. In response to determining that the second set of symbols or the third set of symbols includes the winning combination, a bonus payout amount associated with the selected set of symbols may be determined. An indication of the bonus payout amount may be transmitted to the client device.

In some embodiments, the bonus payout amount may be based on any predetermined locking symbols within the second set of symbols or the third set of symbols.

In some embodiments, the client machine may be associated with a credit account. The credit account may be debited to play the base game, credited in response to the trigger event, and credited by the bonus payout amount.

In some embodiments, the gaming machine may simultaneously execute base games or bonus games in real-time on behalf of at least 30 client machines. Each of the at least 30 client machines may communicate with the gaming machine by way of a wide-area packet-switched network.

The client machine may include the one or more processors and the memory.

Some embodiments may involve simultaneously executing reel-based games in real time on behalf of at least 30 client machines, where each of the at least 30 client machines communicates with the one or more processors by way of a wide-area packet-switched network. In some cases, the one or more processors may simultaneously execute reel-based games in real time on behalf of more or fewer than 30 client machines. For instance, this simultaneous execution may involve 10, 20, 50, 100, or 1000 client machines, or another extent of client machines.

Particularly, simultaneous execution of such a large number of reel-based games in real time necessitates computer implementation. When taking part in an online game, such as the reel-based games disclosed herein, players expect results of reel spin or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of reel-based games in real time would not exist but for computer implementation thereof.

Figure 13:
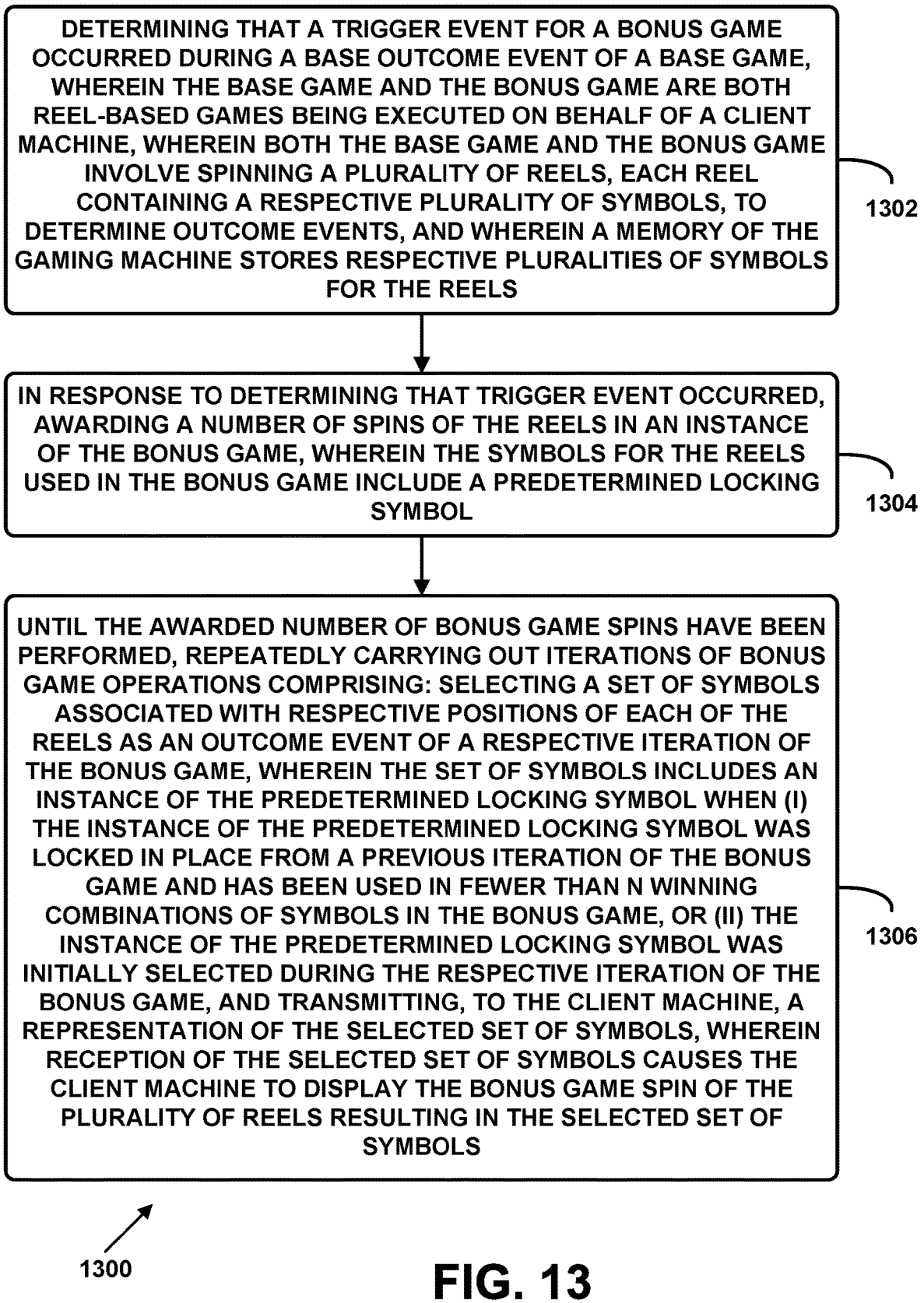
FIG. 13 is a flow chart, in accordance with example embodiments.

FIG. 13 depicts a flow chart showing a set of operations 1300 (or more simply, "the set 1300") that can, for example, be carried out using server machine 100*a* and/or client machine 100*b*. To the extent that a client machine carries out any of the set 1300, these operations may also include displaying various types of information, such as symbol sets, payout amounts, and so on. Note that several of the operations described in connection with FIG. 13 parallel operations described in connection with FIGS. 6A-6D, FIGS. 10A-10D, FIGS. 11A-11C, and FIG. 12. As such, variations of the operations described in connection with FIGS.

6A-6D, FIGS. 10A-10D, FIGS. 11A-11C, and FIG. 12 are likewise applicable to the operations described in connection with FIG. 12.

Block 1302 of FIG. 13 may involve determining that a trigger event for a bonus game occurred during a base outcome event of a base game. The base game and the bonus game may both be reel-based games being executed on behalf of a client machine. Both the base game and the bonus game may involve spinning a plurality of reels, each reel may contain a respective plurality of symbols, to determine outcome events. A memory of the gaming machine may store respective pluralities of symbols for the reels.

Block 1304 may involve, possibly in response to determining that trigger event occurred, awarding a number of spins of the reels in an instance of the bonus game. The symbols for the reels used in the bonus game may include a predetermined locking symbol.

Block 1306 may involve, until the awarded number of bonus game spins have been performed, repeatedly carrying out iterations of bonus game operations. The operations may include selecting a set of symbols associated with respective positions of each of the reels as an outcome event of a respective iteration of the bonus game. The set of symbols may include an instance of the predetermined locking symbol when (i) the instance of the predetermined locking symbol was locked in place from a previous iteration of the bonus game and has been used in fewer than n winning combinations of symbols in the bonus game, or (ii) the instance of the predetermined locking symbol was initially selected during the respective iteration of the bonus game. The operations may also include transmitting, to the client machine, a representation of the selected set of symbols. Reception of the selected set of symbols may cause the client machine to display the bonus game spin of the plurality of reels resulting in the selected set of symbols.

In some embodiments, the instance of the predetermined locking symbol may be unlocked after having been used in n winning combinations of symbols in the bonus game.

In some embodiments, after the instance of the predetermined locking symbol is unlocked, the unlocked predetermined locking symbol may be replaced in a subsequent iteration of the bonus game.

In some embodiments, n may be equal to at least 3.

In some embodiments, the predetermined symbol may be a WILD symbol that is substitutable for other symbols in the reel-based game.

In some embodiments, the selected set of symbols may include two or more instances of the predetermined locking symbol. At least one of the two or more instances of the predetermined locking symbol may have been locked in place from a previous iteration of the bonus game and may have been been used in fewer than n winning combinations of symbols in the bonus game. At least one other of the two or more instances of the predetermined locking symbol may have been initially selected during the respective iteration of the bonus game.

In some embodiments, it may be determined that the selected set of symbols includes no new predetermined symbols and does not include a winning combination. In response to determining that the selected set of symbols includes no new predetermined symbols and does not include the winning combination, the selected set of symbols may be left in their previous respective locked or unlocked states.

In some embodiments, the bonus game operations further include determining that a respective instance of the predetermined locking symbol is used in a winning combination of symbols in the bonus game. In response to determining that the respective instance of the predetermined locking symbol is used in the winning combination of symbols in the bonus game, a counter associated with the respective instance of the predetermined locking symbol may be incremented.

In some embodiments, the bonus game operations may further include determining that the counter indicates that the respective instance of the predetermined symbol has been used in n winning combinations of symbols in the bonus game. In response to determining that the counter indicates that the respective instance of the predetermined symbol has been used in n winning combinations of symbols in the bonus game, the respective instance of the predetermined locking symbol may be unlocked.

In some instances, each reel may include a respective cyclical sequence of symbols. Selecting the set of symbols associated with respective positions of each of the reels may include, for each reel, randomly selecting a respective reel position that displays a subsequence of the symbols on the reel that are part of the selected symbol set.

In some embodiments, selecting the set of symbols associated with respective positions of each of the reels may include simulating a spin of each of the reels.

In some embodiments, the base game and the bonus game may have five reels and each of the five reels may display three symbols at a time.

In some embodiments, the bonus game spin of the plurality of reels resulting in the selected set of symbols may include displaying an animation of the plurality of reels spinning for a particular iteration of the bonus game. Any locked predetermined symbols on the plurality of reels might not spin in the animation.

In some embodiments, the trigger event for the bonus game may include the base outcome event of the base game including at least k trigger symbols. In some embodiments, k may be at least 2.

In some embodiments, when the selected set of symbols includes a winning combination, the bonus game operations may further include determining a bonus payout amount associated with the selected set of symbols and transmitting, to the client device, an indication of the bonus payout amount.

In some embodiments, the bonus payout amount may be based on any predetermined symbols on the plurality of reels.

In some embodiments, the client machine may be associated with a credit account. The credit account may be debited to play the base game, credited in response to the trigger event, and credited by the bonus payout amount.

In some embodiments, the gaming machine may simultaneously execute base games or bonus games in real-time on behalf of at least 30 client machines. Each of the at least 30 client machines may communicate with the gaming machine by way of a wide-area packet-switched network.

In some embodiments, when the instance of the predetermined locking symbol was initially selected during the respective iteration of the bonus game, causing the client machine to display the bonus game spin may include causing the client machine to display an animation of the instance of the predetermined locking symbol freezing over.

In some embodiments, when the instance of the predetermined locking symbol is used in a winning combination of symbols in the bonus game, causing the client machine to display the bonus game spin may include causing the client machine to display an animation of the instance of the predetermined locking symbol partially thawing out.

In some embodiments, an extent of frost surrounding the instance of the predetermined locking symbol may be inversely proportional to a number of winning combinations of symbols in the bonus game in which the instance of the predetermined locking symbol has been used.

In some embodiments, the extent of frost may indicate a remaining lifetime of the instance of the predetermined locking symbol while simultaneously displaying the instance of the predetermined locking symbol.

Figure 14:
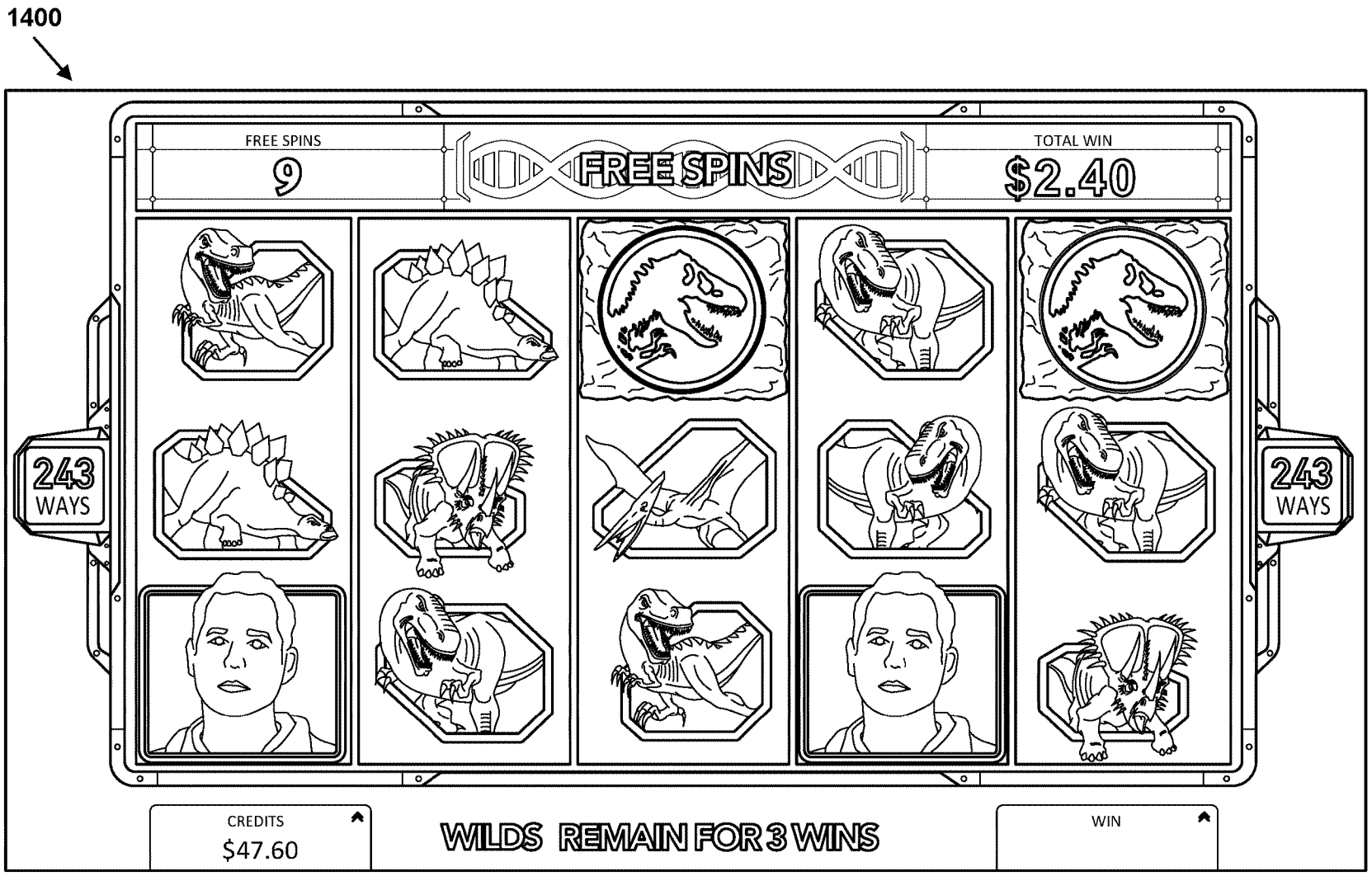
FIG. 14 depicts elements displayable by a display of a machine, in accordance with example embodiments.

FIG. 14 illustrates an example of the animation of the instance of the predetermined locking symbols freezing over. In FIG. 14, display 1400 depicts WILD symbols, acting as predetermined locking symbols, at arrangement positions C3,R1 and C5,R1 on a five-column, three-row matrix of symbols. The WILD symbols are illustrated as circles having therein an outline of the head and arms of a dinosaur. The WILD symbols are initially selected during the iteration of the bonus game illustrated in FIG. 14. In particular, upon initial selection, the WILD symbols are shown completely surrounded by a block of ice.

Figure 15:
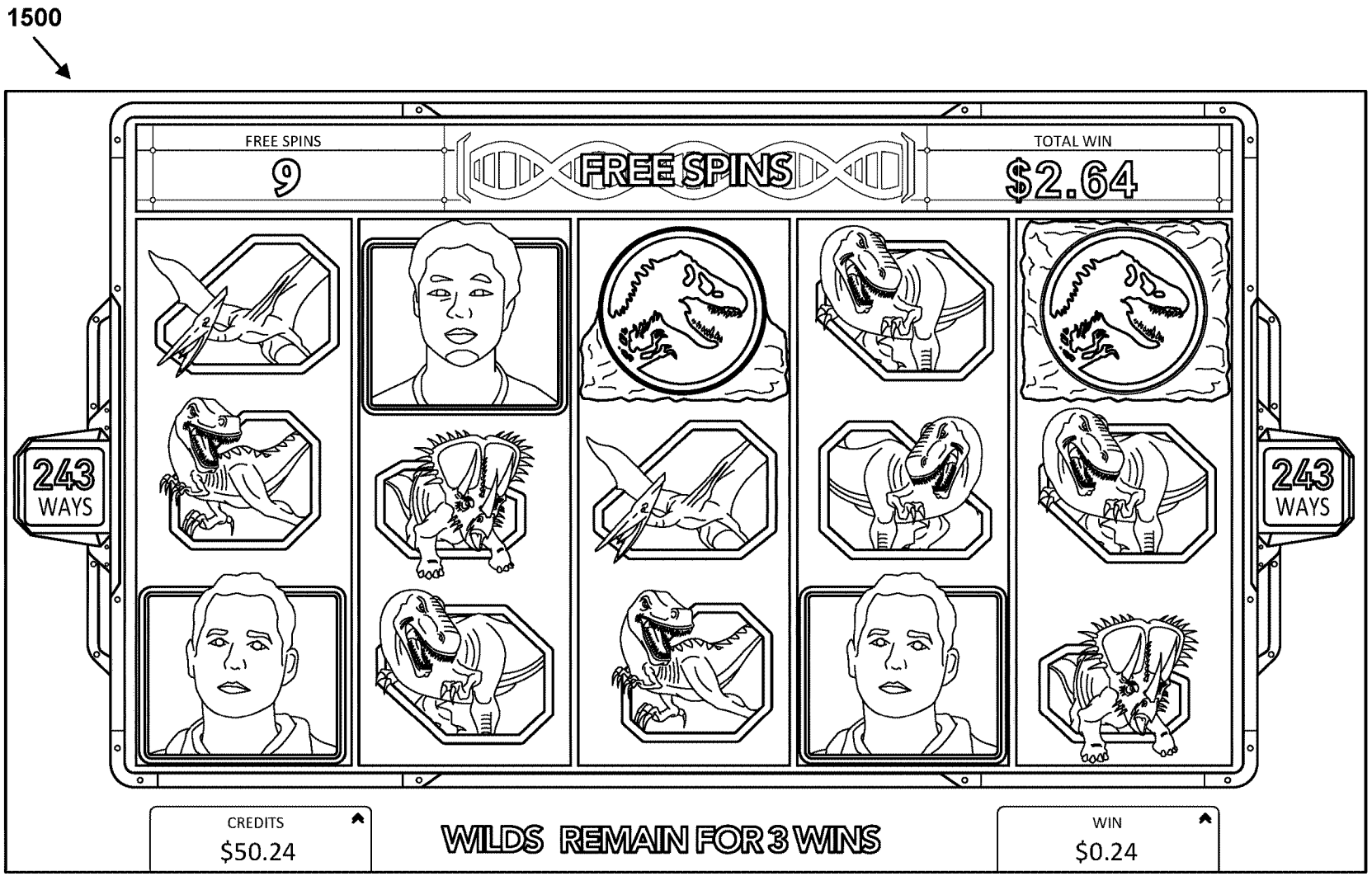
FIG. 15 depicts elements displayable by a display of a machine, in accordance with example embodiments.
Figure 16:
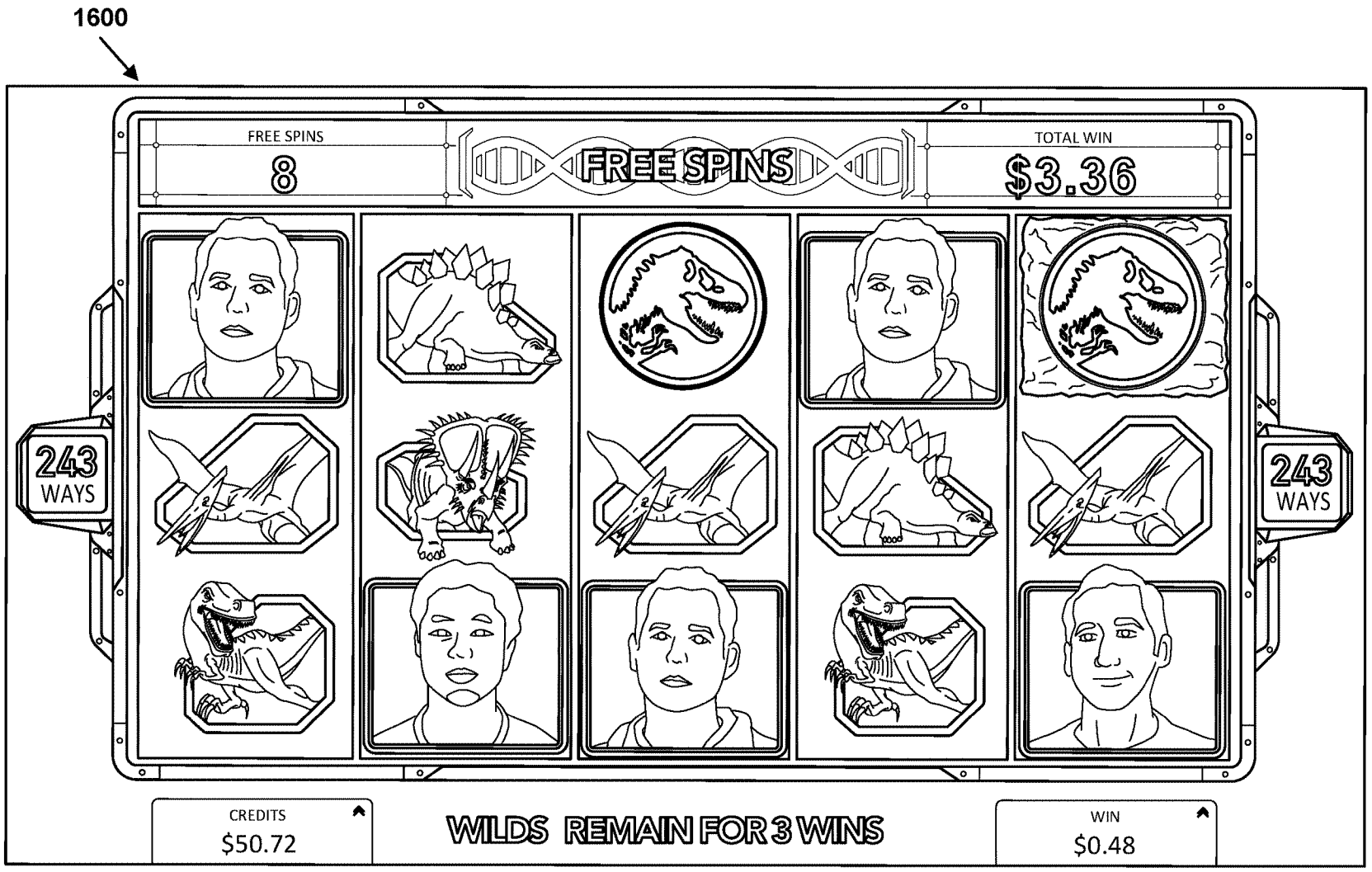
FIG. 16 depicts elements displayable by a display of a machine, in accordance with example embodiments.

As the locked WILD symbols are used to form winning combinations of symbols, the WILD symbols may be shown gradually thawing out, as illustrated in FIG. 15 and FIG. 16. In particular, FIG. 15 illustrates display 1500 with the WILD symbol locked down at arrangement position C3,R1 and partially thawed out after having been used to form part of one winning symbol combination. Additionally, FIG. 16 illustrates display 1600 with the WILD symbol locked down at arrangement position C3,R1 and completely thawed out after having been used to form part of two winning symbol combinations. In the example embodiment illustrates in FIGS. 14-16, the value of n may be equal to 3. Thus, after having formed part of two winning symbol combinations, the WILD symbol locked down at arrangement position C3,R1 may persist to form part of at most one more winning combination, as illustrated by the absence of ice around that WILD symbol. In general, the extent of thawing of a particular locked predetermined locking symbol (i.e., the amount of frost shown surrounding the symbol) may be inversely proportional to the number of winning combinations formed by the particular locked predetermined symbol over the value of n. Thus, the amount of frost surrounding the particular locked predetermined locking symbol may indicate a remaining lifetime of the particular locked predetermined locking symbol while displaying the locked predetermined locking symbol.

The animation of freezing over and gradually thawing out a locked-down symbol may provide a technical solution to indicating a remaining duration of a status condition while also allowing the status condition to be identified without obscuring display of the content of that status condition. For example, the animation illustrated in FIG. 14-FIG. 16 indicates a remaining lifetime of the WILD symbol locked down at arrangement position C3,R1 while enabling the display of the locked-down WILD symbol itself to remain visible.

In a further embodiment that may be a variation of that of FIG. 12 and/or FIG. 13, a gaming system may be configured for symbol replacement in a reel-based game. The reel-based game may be executed on behalf of a client machine, and involve spinning a plurality of reels to determine outcome events.

The gaming system may include a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account.

The gaming system may also include one or more gaming device processors, and one or more gaming device memory devices. The gaming memory devices may store (i) respective pluralities of symbols for the reels and (ii) a plurality of gaming device instructions executable by the one or more gaming device processors to perform any of the operations depicts in reference to FIG. 12 and/or FIG. 13.

V. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method involving a software application executed by a server machine on behalf of a client machine with a graphical display unit, the computer-implemented method comprising:

causing, by a processor of the server machine executing the software application, the graphical display unit to display an initial animation that simulates spinning of a plurality of reels, wherein spinning the reels results in vertical symbol display segments for each of the reels displaying an initial set of symbols;

in response to determining that a trigger event has occurred in the spinning of the reels, determining, by the processor, a number of further spins of the reels, wherein symbols on the reels used in the further spins of the reels include at least one instance of a predetermined locking symbol; and until the number of further spins of the reels have been performed, the processor repeatedly carrying out operations comprising:

selecting a set of symbols associated with respective positions of each of the reels in a respective spin of the further spins of the reels, wherein the set of symbols includes one or more instances of the predetermined locking symbol that were either locked in place from a previous spin of the reels or initially selected during the respective spin of the reels, causing the graphical display unit to display a first animation that simulates the respective spin of the reels, wherein the respective spin of the reels results in the vertical symbol display segments displaying the set of symbols, wherein the instances of the predetermined locking symbol that have been used in 0 winning combinations are shown frozen over, the instances of the predetermined locking symbol that have been used in 1 winning combination are shown partially frozen over, and the instances of the predetermined locking symbol that have been used in 2 winning combinations are shown unfrozen, determining any new winning combinations present in the set of symbols, and for the instances of the predetermined locking symbol that are in any of the new winning combinations, unlocking those that have been used in 3 winning combinations so that they are replaced in a subsequent spin of the reels, and causing the graphical display unit to display a second animation that simulates melting of those that have been used in fewer than 3 winning combinations.

2. The computer-implemented method of claim 1, wherein the predetermined locking symbol is a wild symbol that is substitutable for other symbols in evaluations of the set of symbols.

3. The computer-implemented method of claim 1, wherein the set of symbols includes two or more instances of the predetermined locking symbol, wherein at least one of the two or more instances of the predetermined locking symbol was locked in place from the previous spin of the reels and has been used in fewer than 3 winning combinations of symbols, and wherein at least one other of the two or more instances of the predetermined locking symbol was initially selected during the respective spin of the reels.

4. The computer-implemented method of claim 1, wherein each reel comprises a respective cyclical sequence of symbols, and wherein selecting the set of symbols associated with respective positions of each of the reels comprises:

for each reel, randomly selecting a respective reel position that displays a subsequence of the symbols on the reel that are part of the set of symbols.

5. The computer-implemented method of claim 1, wherein causing the graphical display unit to display the first animation comprises:

causing the first animation to depict the instances of the predetermined locking symbol initially selected during the respective spin of the reels freezing over.

6. The computer-implemented method of claim 1, wherein causing the graphical display unit to display the second animation comprises:

causing the second animation to depict the instances of the predetermined locking symbol that have been used in 1 winning combination thawing out to become partially frozen over.

7. The computer-implemented method of claim 1, wherein the software application has five reels and each of the five reels displays three symbols at a time.

8. The computer-implemented method of claim 1, wherein the trigger event comprises the initial set of symbols including at least 2 trigger symbols.

9. The computer-implemented method of claim 1, wherein the processor simultaneously executes the software application in real-time on behalf of at least 30 client machines, and wherein each of the at least 30 client machines communicates with the server machine by way of a wide-area packet-switched network.

10. A non-transitory computer-readable medium having stored thereon program instructions that define a software application, wherein the software application is executed by a server machine on behalf of a client machine with a graphical display unit, wherein, upon execution by the server machine, the program instructions cause the server machine to perform operations comprising:

causing, by a processor of the server machine executing the software application, the graphical display unit to display an initial animation that simulates spinning of a plurality of reels, wherein spinning the reels results in vertical symbol display segments for each of the reels displaying an initial set of symbols;

in response to determining that a trigger event has occurred in the spinning of the reels, determining, by the processor, a number of further spins of the reels, wherein symbols on the reels used in the further spins of the reels include at least one instance of a predetermined locking symbol; and until the number of further spins of the reels have been performed, the processor repeatedly carrying out operations comprising:

selecting a set of symbols associated with respective positions of each of the reels in a respective spin of the further spins of the reels, wherein the set of symbols includes one or more instances of the predetermined locking symbol that were either locked in place from a previous spin of the reels or initially selected during the respective spin of the reels, causing the graphical display unit to display a first animation that simulates the respective spin of the reels, wherein the respective spin of the reels results in the vertical symbol display segments displaying the set of symbols, wherein the instances of the predetermined locking symbol that have been used in 0 winning combinations are shown frozen over, the instances of the predetermined locking symbol that have been used in 1 winning combination are shown partially frozen over, and the instances of the predetermined locking symbol that have been used in 2 winning combinations are shown unfrozen, determining any new winning combinations present in the set of symbols, and for the instances of the predetermined locking symbol that are in any of the new winning combinations, unlocking those that have been used in 3 winning combinations so that they are replaced in a subsequent spin of the reels, and causing the graphical display unit to display a second animation that simulates melting of those that have been used in fewer than 3 winning combinations.

11. The non-transitory computer-readable medium of claim 10, wherein causing the graphical display unit to display the first animation comprises:

causing the first animation to depict the instance of the predetermined locking symbol initially selected during the respective spin of the reels freezing over.

12. The non-transitory computer-readable medium of claim 10, wherein causing the graphical display unit to display the second animation comprises:

causing the second animation to depict the instance of the predetermined locking symbol that have been used in 1 winning combination thawing out to become partially frozen over.

13. A system configured for executing a software application, the system comprising:

a client machine including a client machine processor, a client machine memory, a graphical display unit, and a plurality of input devices, wherein the plurality of input devices include: (i) an acceptor of a physical item associated with a monetary value, (ii) a validator configured to identify the physical item, and (iii) a cash-out button actuatable to cause an initiation of a payout associated with a credit account; and program instructions executable to perform operations comprising:

causing the graphical display unit to display an initial animation that simulates spinning of a plurality of reels, wherein spinning the reels results in vertical symbol display segments for each of the reels displaying an initial set of symbols;

in response to determining that a trigger event has occurred in the spinning of the reels, determining a number of further spins of the reels, wherein symbols on the reels used in the further spins of the reels include at least one instance of a predetermined locking symbol; and until the number of further spins of the reels have been performed, repeatedly carrying out operations comprising:

selecting a set of symbols associated with respective positions of each of the reels in a respective spin of the further spins of the reels, wherein the set of symbols includes one or more instances of the predetermined locking symbol that were either locked in place from a previous spin of the reels or initially selected during the respective spin of the reels, causing the graphical display unit to display a first animation that simulates the respective spin of the reels, wherein the respective spin of the reels results in the vertical symbol display segments displaying the set of symbols, wherein the instances of the predetermined locking symbol that have been used in 0 winning combinations are shown frozen over, the instances of the predetermined locking symbol that have been used in 1 winning combination are shown partially frozen over, and the instances of the predetermined locking symbol that have been used in 2 winning combinations are shown unfrozen, determining any new winning combinations present in the set of symbols, and for the instances of the predetermined locking symbol that are in any of the new winning combinations, unlocking those that have been used in 3 winning combinations so that they are replaced in a subsequent spin of the reels, and causing the graphical display unit to display a second animation that simulates melting of those that have been used in fewer than 3 winning combinations.

* * * * *